US007873312B2

(12) United States Patent
Umeda et al.

(10) Patent No.: US 7,873,312 B2
(45) Date of Patent: Jan. 18, 2011

(54) TRANSFER APPARATUS, METHOD OF MANUFACTURING THE TRANSFER APPARATUS AND IMAGE FORMING APPARATUS USING THE TRANSFER APPARATUS

(75) Inventors: Takao Umeda, Hitachinaka (JP); Hiroyuki Mabuchi, Hitachinaka (JP); Shunichi Oohara, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 489 days.

(21) Appl. No.: 11/960,924

(22) Filed: Dec. 20, 2007

(65) Prior Publication Data

US 2008/0152399 A1 Jun. 26, 2008

(30) Foreign Application Priority Data

Dec. 25, 2006 (JP) ..... 2006-348106
Jun. 4, 2007 (JP) ..... 2007-148123

(51) Int. Cl.

*G03G 15/18* (2006.01)
*G03G 15/08* (2006.01)
*G03G 15/20* (2006.01)
*G03G 15/16* (2006.01)
*G03G 21/12* (2006.01)

(52) U.S. Cl. ..... 399/319; 399/154; 399/261; 399/310; 399/348

(58) Field of Classification Search ..... 399/121, 399/154, 261, 310, 311, 319; 310/330, 331, 310/353, 367

See application file for complete search history.

(56) References Cited

U.S. PATENT DOCUMENTS

| | | | | |
|---|---|---|---|---|
| 3,622,815 | A * | 11/1971 | Schafft | 310/332 |
| 4,237,399 | A * | 12/1980 | Sakamoto | 310/317 |
| 5,517,291 | A * | 5/1996 | Montfort et al. | 399/319 |
| 6,385,429 | B1 * | 5/2002 | Weber et al. | 399/319 |
| 2002/0011111 | A1 * | 1/2002 | Otsuchi et al. | 73/514.34 |

FOREIGN PATENT DOCUMENTS

| | | |
|---|---|---|
| JP | 52-037042 | 3/1977 |
| JP | 55-020231 | 5/1980 |
| JP | 60-102778 | 6/1985 |
| JP | 62-248953 | 10/1987 |
| JP | 04-020276 | 4/1992 |
| JP | 04-234076 | 8/1992 |
| JP | 04-234082 | 8/1992 |
| JP | 2005-303937 | 10/2005 |

* cited by examiner

*Primary Examiner*—David M Gray
*Assistant Examiner*—Francis Gray
(74) *Attorney, Agent, or Firm*—Antonelli, Terry, Stout & Kraus, LLP.

(57) ABSTRACT

A transfer apparatus comprises a toner image supporting body and a corona transfer means, which are oppositely disposed, and a vibrating unit for exerting vibration force to the rear face of a toner supporting body, disposed opposite to the corona transfer means, wherein the vibrating unit has a cantilever structure for holding an end of a piezoelectric bimorph element in which a pair of piezoelectric bodies each having an electrode, are bonded to both sides of a conductive elastic member (a shim member). A protrusion portion is provided on the other end of the piezoelectric bimorph element.

23 Claims, 17 Drawing Sheets

TRANSFER APPARATUS, METHOD OF MANUFACTURING THE TRANSFER APPARATUS AND IMAGE FORMING APPARATUS USING THE TRANSFER APPARATUS

CLAIM OF PRIORITY

The present application claims priority from Japanese application serial No. 2007-148123, filed on Jun. 4, 2007, which claims priority from Japanese patent application serial No. 2006-348106, filed on Dec. 25, 2006, the contents of which are hereby incorporated by reference into this application.

BACKGROUND OF THE INVENTION

1. Field of the Invention

The present invention relates to a transfer apparatus, a method of manufacturing the transfer apparatus and an image forming apparatus using the transfer apparatus.

2. Description of Related Art

An image forming apparatus using the electronic photographic method transfers a toner image formed on a toner image supporting body such as a photosensitive belt or an intermediate transfer body, to a recording medium, and melts and fixes the toner image on the surface of the recording medium by using a fixing device. FIGS. 14(*a*) and 14(*b*) illustrate a conventional transfer apparatus; negatively charged toner on the photosensitive belt 25 or intermediate transfer belt 19 is transferred to the paper 16 having concaves 17.

FIG. 14(*a*) illustrates transfer to roughened surface paper as typical inexpensive paper or to a paper surface including concaves 17, such as a second surface deformed by heat generated during the fixing of a toner image to a first surface. The depth d of the concave 17 is 30 to 50 μm, and the width Wh of the concave is 8 to 10 mm. In this transfer, the negatively charged toner 21 needs to be attracted to the paper 16 by an electrostatic field acting between positive charges 20 supplied to the back of the paper 16 by the corona transfer unit 18 and the electrode layer 25*b* of the photosensitive belt. On the flat part of the paper 16, a toner image is brought into close contact with the surface of the paper 16 and thus a sufficient transfer electric field is applied to the toner 21*a*, so the toner 21*a* is efficiently transferred. For the toner 21*b* facing the concave 17 on the surface of the paper 16, there is a void with a depth of d between the concave 17 and the surface of the paper 16, so the transfer electric field acting on the toner 21*b* is weakened, lowering the toner transfer efficiency and thereby causing an image failure.

FIG. 14(*b*) illustrates transfer of a color toner image formed on the intermediate transfer belt 19 to a surface of an embossed paper on which concaves and convexes are artificially formed by performing embossing on coated paper to form a embossed processing such as aventurine lacquer, the texture, the fine grain photoprint. Embossed paper is used to form tickets and front covers of catalogs and brochures. Although the depth d of the concave 17 varies with the type of embossing, the depth d falls within the range of 10 to 30 μm; the width Wh of the concave is 0.2 to 0.4 mm. In this transfer, the color toners of two or three layers formed on the intermediate transfer belt 19 need to be transferred together to the interior of the concave 17, which is narrower than the former concave 17. The transfer electric field is weak for the toner layer facing the concave 17 as in the transfer in FIG. 14(*a*), and since the image is in color, toners are stacked in a plurality of layers. Accordingly, the transfer electric field is less likely to act on the toners 21*a*, 22*a*, 23*a*, and 24*a*, which are to be brought into contact with the surface of the intermediate transfer belt 19, further lowering transfer efficiency of the toners 21*a*, 22*a*, 23*a*, and 24*a*.

FIGS. 15(*a*) and 15(*b*) illustrate forces exerted on toner during electrostatic transfer. In FIG. 15(*a*), a force is exerted on the toner 21 formed on the surface of the toner image supporting body 38 such as a photosensitive belt or an intermediate transfer belt, when the toner 21 is transferred to the paper 16 by using the corona transfer unit 18. The force by which the toner 21 is attracted to the surface of the toner image supporting body 38 is the sum of a mirror image force $F_M$ and van der Waals's force $F_f$. The force to attract the toner 21 to the paper 16 is an electrostatic force $F_E$ based on the positive charge 20 (having a polarity opposite to the polarity of the charge on the toner) supplied to the back of the paper 16.

To overcome the resultant of the mirror image force $F_M$ and van der Waals's force $F_f$ so as to transfer the toner 21 to the paper 16, the electrostatic force $F_E$ needs to be increased. A method for this is to increase the transfer electric field E by increasing a voltage/current applied to the corona transfer unit 18 so as to increase the corona charge amount of positive charges 20 supplied to the back of the paper 16. If the intensity of the transfer electric field E becomes too high, however, the electric field is locally concentrated and thereby the toner 21 scatters, lowering the image quality. A possible method of solving this problem is to reduce the force to attract the toner 21 to the toner image supporting body 38 (the sum of mirror image force $F_M$ and van der Waals's force $F_f$) and to supply another force to the toner 21 so as to direct the toner 21 toward the paper 16.

The mirror image force $F_M$ is electrostatic force acting between the charge on the toner 21 and a mirror image charge generated on the toner image supporting body 38; it depends on the particle diameter and charge of the toner 21 as well as the dielectric constant and thickness of the toner image supporting body 38. The van der Waals's force $F_f$, which is a non-electrostatic force, is derived from the following equation.

$$F_f = A \times R/(6 \times D^2) \quad (1)$$

A is the Hamaker constant, which depends on the materials of the toner 21 and toner image supporting body 38. R is the radius of a toner particle. D is a distance between the toner 21 and the toner image supporting body 38. As seen from equation (1), $F_f$ is proportional to the radius R and inversely proportional to the square of the distance D between the toner 21 and the surface of the toner image supporting body 38.

To reduce the force to attract the toner 21 to the surface of the photosensitive body, as shown in FIG. 15(*b*), an apparatus 39 for vibrating the toner image supporting body 38 is disposed so as to touch the backside of the toner image supporting body 38; when the toner image supporting body 38 is vibrated up and down, an inertia force $F_B$ is applied; the sum of $F_B$ and $F_E$ increases a force to separate the toner from the toner image supporting body 38 so as to move and transfer the toner 21 to the interior of the concave 17 in the paper 16. The inertia force $F_B$ depends on the weight of the toner 21, the vibration frequency, and the vibration displacement, as described later. The inertia force $F_B$ applied enables it possible to transfer a monochrome toner image (FIG. 15(*a*)) and to transfer a color toner image comprising a plurality of layers (FIG. 14(*b*)) to the paper 16 having concaves and convexes on its front surface.

As a means for applying vibration energy from the backside of the toner image supporting body 38 such as a photosensitive belt or an intermediate transfer belt, methods in which an electromagnetic oscillator or ultrasonic oscillator is used are proposed (Patent Document 1). Of these, only the method in which an ultrasonic oscillator is used is put into practical use.

In this method, as illustrated in FIG. 15(*b*), a horn 39*a* and an ultrasonic oscillator 39*b* that uses longitudinal vibration ($d_{33}$ mode) of a piezoelectric body are combined to structure a resonator with a frequency of 20 to 100 kHz and a vibration displacement of several micrometers; vibration energy is applied to the toner 21 through the toner image supporting body 38 by bringing the vibrating end of the horn 39*a* into contact with the backside of the toner image supporting body 38 such as a photosensitive belt or an intermediate transfer belt, so that the toner 21 generates an inertia force $F_B$, improving the efficiency of transfer of the toner 21 to the paper 16.

Patent Document 1: Japanese Patent Laid-open No. Sho 55(1980)-20231

Patent Document 2: Japanese Patent Laid-open No. Hei 04(1992)-234076

Patent Document 3: Japanese Patent Laid-open No. Hei 04(1992)-234082

Patent Document 4: Japanese Patent Laid-open No. Sho 62(1987)-248953

Patent Document 5: Japanese Patent Publication No. Hei 04(1992)-20276

Patent Document 6: Japanese Patent Laid-open No. 2005-303937

SUMMARY OF THE INVENTION

Wide printing is increasingly demanded for printers, copiers, and other image forming apparatuses. Cut-sheet printers are demanded to support the A3 size and wider, and continuous printers are demanded to support 20-inch width and wider. Accordingly, the toner image supporting body is also widened, and an area to which vibration energy is supplied by a vibrating source is 420 mm to 500 mm or more in width.

The width that the vibrating unit can cover is determined by the resonance characteristics of the ultrasonic oscillator 39*b* and horn 39*a*; the range of the width the vibrating unit can support is 2 to 3 inches. To support 20 inches or more, seven to ten or more resonators need to be aligned. This raises a problem that mutual interference (a phenomenon called cross coupling) is caused when a plurality of resonators are driven. Countermeasures, for example, for preventing adjacent horns from being brought into mutual contact (Patent Document 2) are needed. In this case, however, vibration energy cannot be supplied to the toner image supporting body between the adjacent horns.

When a plurality of resonators are disposed, the mutual interference impedes individual resonators from having uniform vibration characteristics (mainly, the vibration rate). Particularly, the vibration rate tends to be lowered at both sides. Since different driving voltages thereby need to be applied to the central part and both sides so that the vibration characteristics become uniform, countermeasures, for example, for driving different resonators with different voltages (Patent Document 3) are disposed.

In general, a Langevin oscillator tightened with bolts is used as the ultrasonic oscillator. Oscillators of this type are aligned. To drive a single Langevin oscillator, 70 to 140 W of electric power is needed, so hundreds of watts is needed to support the 20-inch width. Therefore, a power supply of high frequency and high voltage operating at a frequency of 20 kHz or higher is required, resulting in a high cost.

The present invention addresses the above problem involved in the prior art with the object of providing a transfer apparatus that enables transfer to embossed paper having concaves and convexes on its surface or to roughened surface paper and also enables superior toner transfer, without image failures, to concaves on a second surface of paper that are formed when the paper is deformed (for example, wrinkled) by heat generated during the fixing of toner image to a first surface, as well as an image forming apparatus that uses the transfer apparatus.

The present invention relates to a transfer apparatus having a corona transfer means, which faces a toner image supporting body such as a photosensitive belt or an intermediate transfer belt, and transfers a toner image formed on the toner image supporting body to a recording medium transferred to a transfer area disposed between the toner image supporting body and the corona transfer means, and also relates to an image forming apparatus using the transfer apparatus.

BRIEF DESCRIPTION OF THE DRAWINGS

FIGS. 19A-1 to 19D are exploded perspective views illustrating the piezoelectric bodies in the present invention.

DETAILED DESCRIPTION OF THE INVENTION

Figure 1:
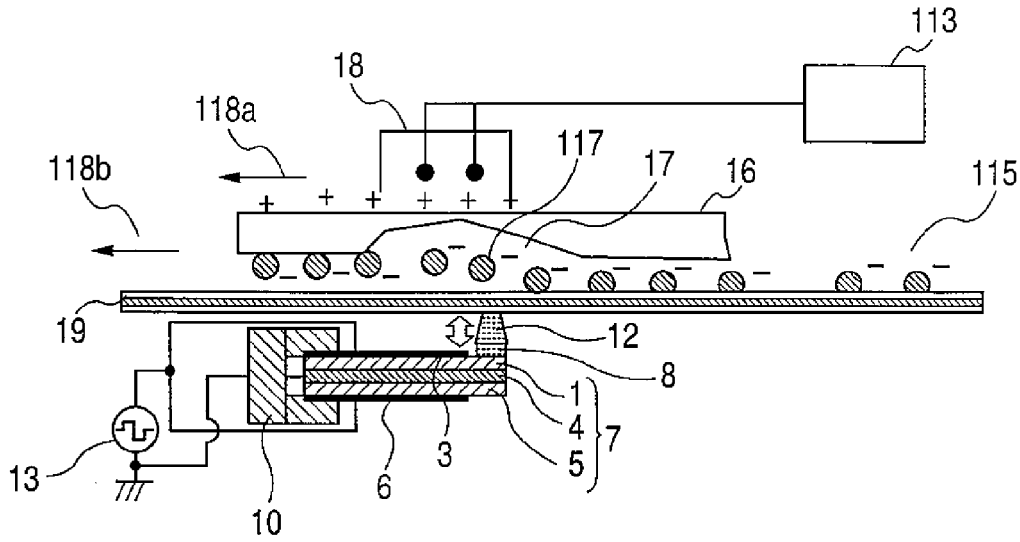
FIG. 1 is a structural diagram illustrating a transfer apparatus in the first embodiment of the present invention.

The present invention, which is a transfer apparatus, comprises a toner image supporting body; a corona transfer means, which is oppositely disposed to a toner image supporting body, wherein an electrostatic toner image formed on the toner image supporting body is transferred to a recording medium transported to a transfer area disposed between the toner image supporting body and the corona transfer means; and a vibrating unit that applies vibration energy to a back side of the toner image supporting body, the vibrating unit being disposed opposite to the corona transfer means with the toner image supporting body intervening therebetween, wherein: the vibrating unit has a cantilever structure for holding one end of a piezoelectric bimorph-type actuator having such a structure that a pair of piezoelectric bodies each having an electrodes on the surface thereof are bonded, and a protrusion portion is provided at an end of the cantilever opposite to a supporting and fixing part of the piezoelectric bimorph-type actuator, and reciprocal vibration, which is caused when a voltage is applied to the pair of piezoelectric bodies, is transmitted to the back side of the toner image supporting body through the protrusion portion. Better toner transfer with lower power consumption is possible without power supply of a high frequency and a high voltage hereby, in comparison with a conventional method using an ultrasound transducer.

The present invention, which is a transfer apparatus for electrostatically transferring a toner image formed on a toner image supporting body, includes a corona transfer means disposed opposite to the toner image supporting body and a vibrating means disposed opposite to the corona transfer means so as to supply vibration energy to the backside of the toner image supporting body; the vibrating means has a cantilever structure that supports an end of a piezoelectric bimorph element structured by attaching a pair of piezoelectric bodies, each of which has an electrode on its front surface, to both surfaces of a conductive elastic member (it is called a shim member in the following sentences), a protrusion portion being provided on the other end of the piezoelectric bimorph element; when a driving voltage is applied across the shim member and the electrode on the front surface of the piezoelectric body, no voltage is applied to an area, on the piezoelectric body area, in which the piezoelectric bimorph element is supported. This constitution makes a life of the piezoelectric bimorph element longer.

The piezoelectric bimorph element occupies areas in which the electrodes on the front surfaces of the piezoelectric bodies and the shim member are overlapped, the piezoelectric bodies and the shim member constituting the piezoelectric bimorph element; an area on the piezoelectric body in which the piezoelectric bimorph element is supported is not included on the piezoelectric body area, in which distortion occurs substantially due to a reverse piezoelectric effect.

The piezoelectric bimorph element occupies areas in which the electrodes on the front surfaces of the piezoelectric bodies and the shim member are overlapped, the piezoelectric bodies and the shim member constituting the piezoelectric bimorph element; only a vibration area including a free end of the piezoelectric bimorph element is included on the piezoelectric body area, in which distortion occurs substantially due to a reverse piezoelectric effect.

A piezoelectric ceramic plate or piezoelectric film, which is part of the piezoelectric bimorph element, undergoes polarization over its surface in the thickness direction; an electrode for driving the piezoelectric bimorph element is formed only a particular area on the surface of the piezoelectric ceramic plate or piezoelectric film.

The transfer apparatus is a wide bimorph cell in which the piezoelectric body is a piezoelectric ceramic plate or piezoelectric film, the width of the shim member is equal to or more than the width of the transfer area from which a transfer occurs to the recording medium, a plurality of piezoelectric bodies are provided in the direction of the width of the transfer area width at fixed intervals, and expansion and contraction of each of the plurality of the piezoelectric bodies, which occur when a voltage is applied, are transferred to the transfer area by using the shim member as a common base.

The image forming apparatus in the invention comprises a toner image supporting body, such as an intermediate transfer belt or a photosensitive belt, which rotates and on the surface on which a toner image is formed, and a transfer unit, disposed opposite to the toner image supporting body, for transferring the toner image to a recording medium; the transfer apparatus described above is used as the transfer unit.

The present invention relates to a new transfer apparatus for an image forming apparatus comprising a bimorph type actuator, in which a plurality of piezoelectric bodies are bonded to both sides of a single shim member (an elastic reinforcing plate) and a cantilever structure holding an end of the actuator and a protrusion portion is provided on the other end and reciprocal vibration is applied to a toner supporting body. Advantages of the present invention is that a uniform vibration can be given to an overall width of the toner supporting body and that a cross coupling phenomenon does not occur and a single actuator can give the vibration to a wide printing (wider than 20 inches) since movement of the plural piezoelectric bodies appears as movement of a single shim member. As a driving voltage of the actuator in the present invention is 10 to 40 volts, it can decrease to ½ to ⅓ times voltage of a conventional resonator type actuator, and a driving frequency of the actuator in the present invention is equal to or less than 20 kHz. In addition, a power consumption of the actuator in the present invention can be reduced to a fraction (about ⅓ to 1/10).

In the piezoelectric bimorph element according to embodiments of the present invention, a reverse piezoelectric effect occurs only in the free end area during driving. Accordingly, the following advantage is obtained.

No stress occurs on a boundary between the piezoelectric bimorph element and a fixing member. When vibration occurs at a high frequency with a large displacement, piezoelectric ceramic plates (PZT), which are part of the piezoelectric bimorph element, are not damaged, making the vibrating means highly reliable.

Further, the same advantage can be obtained in the piezoelectric bimorph element for a width transfer because the element structure of the invention can be applied to the wide shim member.

The device structure according to the present invention can also be applied to a shim member, so the same advantage can be obtained from a piezoelectric bimorph element ready for wide transfer.

Embodiments of the present invention will be described in detail with reference to the drawings.

First, the main structure of a vibrating unit, which is the main part of the transfer apparatus in the invention, will be described.

As a means for vibrating a wide toner image supporting body at high speed, the vibrating unit in the present invention uses the bimorph-type actuator method in which transverse effect vibration ($d_{31}$ mode) of a piezoelectric body is employed, rather than the resonator method in which longitudinal vibration ($d_{33}$ mode), which causes mutual interference (cross coupling), is employed.

Figure 12A:
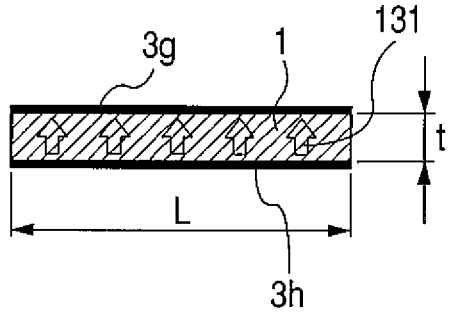
FIGS. 12A to 12C are drawings illustrating a transverse effect vibration of a piezoelectric body.
Figure 12B:
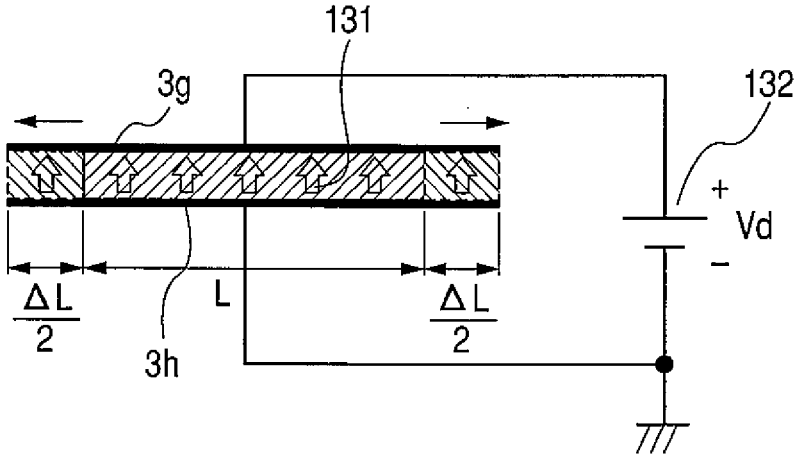
Figure 12C:
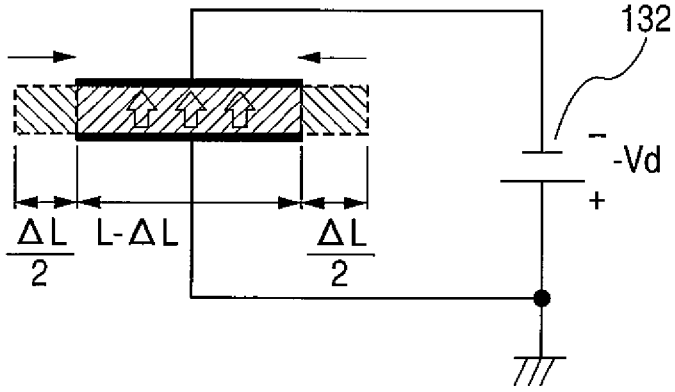
Figure 13A:
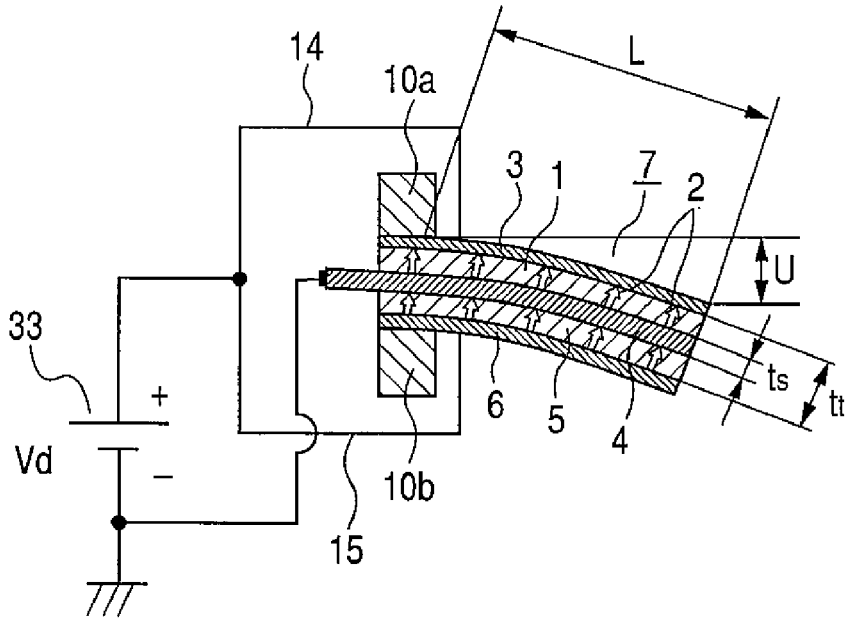
FIGS. 13A and 13B are drawings illustrating the structures of the piezoelectric bimorph element and its displacement characteristics when a voltage is applied to it.
Figure 13B:
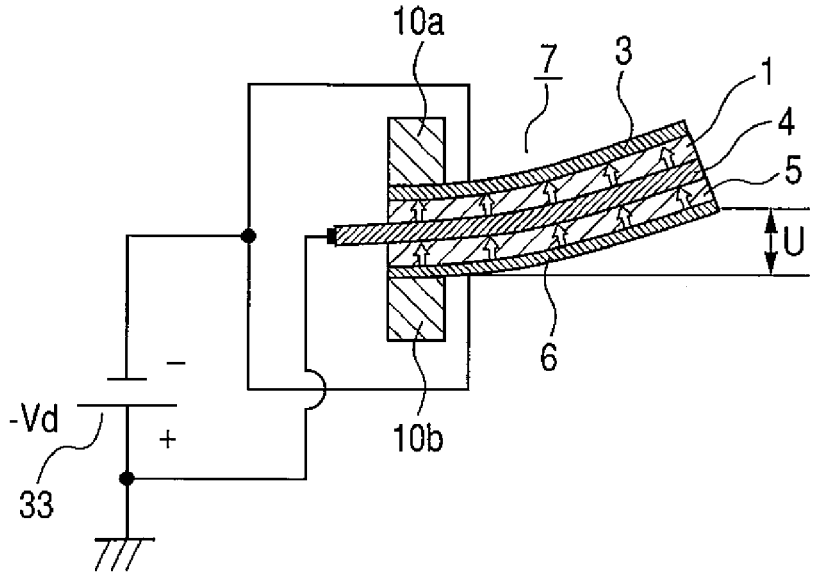
Figure 14A:
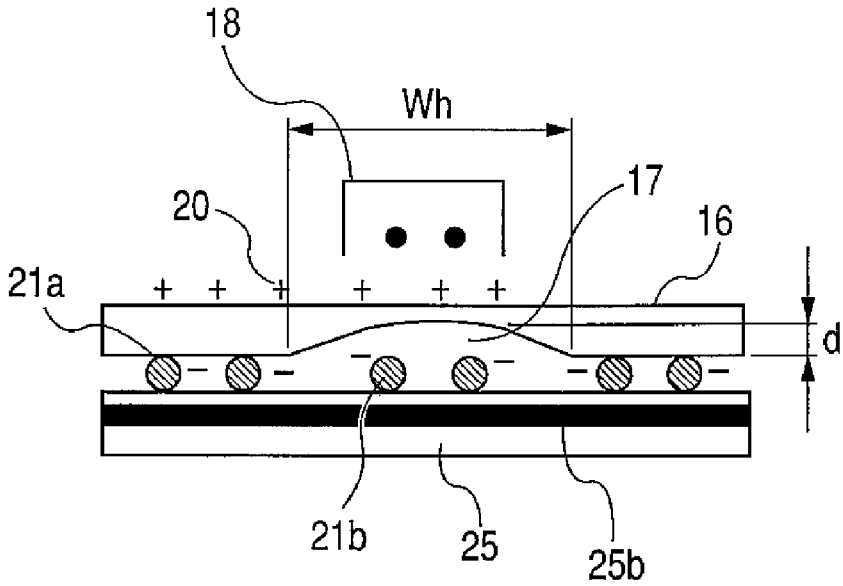
FIGS. 14A and 14B are drawings illustrating electrostatic transfer of toner to paper having uneven surface.
Figure 14B:
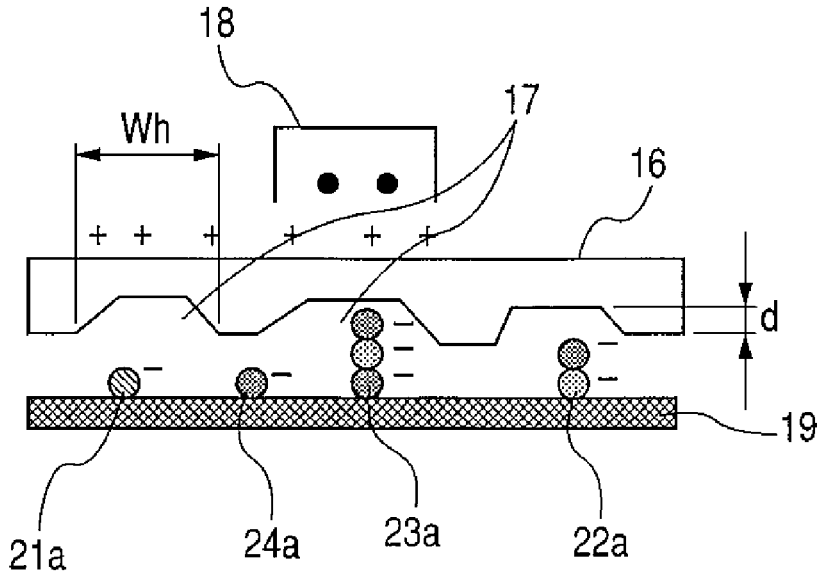
Figure 15A:
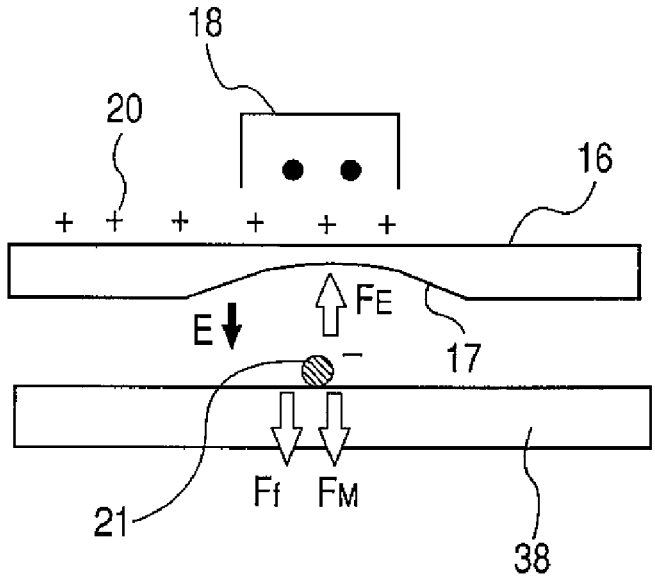
FIGS. 15A and 15B are drawings illustrating a force exerted on the toner during the electrostatic transfer.
Figure 15B:
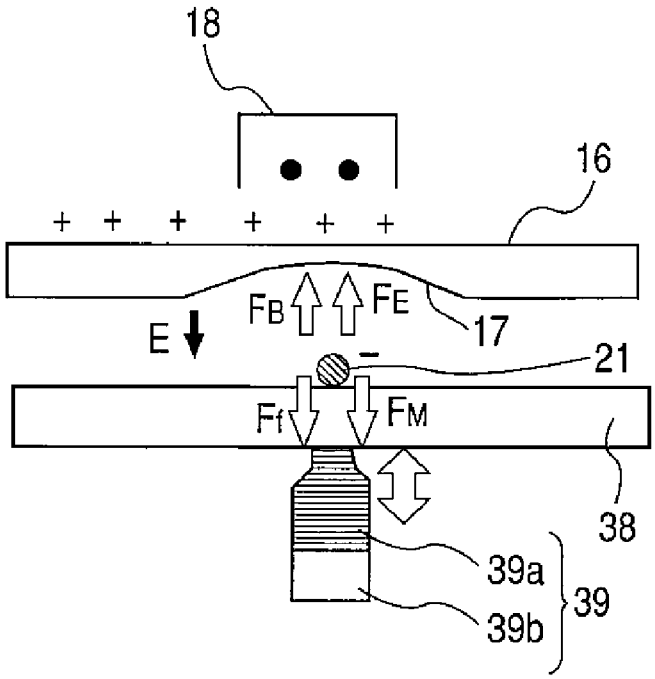

FIGS. 12(*a*) and 12(*b*) and FIGS. 13(*a*) to 13(*c*) illustrate a piezoelectric bimorph element; the principle of operation of a piezoelectric bimorph element 7 using the reverse piezoelectric effect of a piezoelectric body based on ceramics such as lead zirconate titanate (PZT) or a piezoelectric film made of, for example, polyvinyliden difluoride (PVDF) is shown.

FIGS. 12(*a*) to 12(*c*) illustrate the operation of an actuator having a transverse effect, which causes expansion and contraction in a direction perpendicular to the thickness of the piezoelectric body, that is, in the plane direction, when a voltage is applied in the thickness direction. In FIG. 12(*a*), electrodes 3*g* and 3*h* are formed on the surfaces of the piezoelectric body 1 based on ceramics such as lead zirconate titanate (PZT) or a piezoelectric film made of, for example, polyvinyliden difluoride (PVDF).

Reference numeral 131 indicates spontaneous polarization of the piezoelectric body 1. FIG. 12(*b*) illustrates a case in which a DC voltage Vd is applied to the piezoelectric body 1 by a DC power supply 132 so that an electric field is generated in a direction opposite to the direction of the spontaneous polarization 131. The piezoelectric body 1 expands toward both ends in the plane direction, by ΔL/2 each.

FIG. 12(*c*) illustrates another case in which a DC voltage Vd is applied to the piezoelectric body 1 so that an electric field is generated in the same direction as the direction of the spontaneous polarization 131. The piezoelectric body 1 contracts from both ends in the plane direction, by ΔL/2 each. The amount of expansion or contraction ΔL can be represented by using the piezoelectric distortion constant $d_{31}$, length L, and thickness t of the piezoelectric body 1, as in equation (2).

$$\Delta L = d_{31} \times L \times Vd/t \quad (2)$$

The value of the piezoelectric distortion constant $d_{31}$ varies with the composition of the material of the piezoelectric body. Even materials comprehensively classified as PZT, the piezoelectric distortion constant of which varies within the range of $80\times10^{-12}$ m/V to $375\times10^{-12}$ C/N, are used in practical applications.

The reverse piezoelectric effect in FIGS. 13(*a*) and 13(*b*) is a phenomenon in which distortion occurs in proportional to the intensity of an electric field applied to the piezoelectric body. In the piezoelectric bimorph element 7, the piezoelectric body 1 is bonded to one side of a shim member (referred to below as the shim member) 4, and the piezoelectric body 5 is bonded to the other side, their spontaneous polarization 2 being in the same direction. A conductive adhesive is used for this bonding so as to eliminate the need to increase a driving voltage shared by the adhesive layers. An electrode 3 is formed on the surface of the piezoelectric body 1, and an electrode 6 is formed on the surface of the piezoelectric body 5. A voltage Vd is applied across the electrode 3 and the shim member 4 from a DC power supply 33 through a power feeding line 14; voltage Vd is also applied across the electrode 6 and the shim member 4 through a power feeding line 15. A cantilever structure is used in which one end of the piezoelectric bimorph element 7 is held between supporting and fixing members 10*a* and 10*b*.

In FIG. 13(*a*), the electrodes 3 and 6 of the piezoelectric bodies 1 and 5 are positive, and the shim member 4 is grounded. The piezoelectric body 1 contracts because an electric field is applied in the same direction as the direction of its spontaneous polarization 2. The piezoelectric body 5 expands because an electric field is applied in a direction opposite to the direction of its spontaneous polarization 2. As a result, the piezoelectric bimorph element 7 is curved upward with a displacement U, with the shim member 4 being the central axis.

In FIG. 13(*b*), the electrodes 3 and 6 of the piezoelectric bodies 1 and 5 are ground, and the shim member 4 is positive. The piezoelectric bimorph element 7 is curved downward with the displacement U. When AC current is applied to the piezoelectric bimorph element 7, the states in FIGS. 13(*a*) and 13(*b*) are alternately repeated, causing up and down vibration.

The displacement U and resonant frequency f of the piezoelectric bimorph element 7 are given by equations (3) and (4).

$$\text{Displacement } U(m) = 3\times d_{31}\times(L/t_t)^2\times(1+t_s/t_t)\times\alpha\times V \quad (3)$$

$$\text{Resonant frequency } f(Hz) = 0.162\times(t_t/L^2)\times\sqrt{(Y-\rho)} \quad (4)$$

where $t_t$ is the total thickness of the piezoelectric bodies 1 and 5 as well as the shim member 4, $t_s$ is the thickness of the shim member 4, α is a nonlinear compensation constant, which is 2, Y is a Young's modulus as the piezoelectric bimorph element 7 (including the piezoelectric bodies 1, 5 and shim member 4), ρ is a density as the bimorph cell, $d_{31}$ is the piezoelectric distortion constant, L is a vibration length, and V is an applied voltage.

The vibration frequency of the piezoelectric bimorph element 7 is several kilohertz or less, which is lower than the vibration frequency of an ultrasonic oscillator. However, its displacement U is hundreds of micrometers to several millimeters. By comparison, the displacement of the ultrasonic oscillator is 10 μm or less; the piezoelectric bimorph element is greater in the displacement U than the ultrasonic oscillator by a few orders of magnitude. Other features of the piezoelectric bimorph element are low driving power and absence of electromagnetic noise.

PZT piezoelectric ceramics and a PVDF piezoelectric film will be described. To form PZT piezoelectric ceramics, powder of PbO, $TiO_2$, $ZrO_2$, and the like are mixed and crashed, and then tentatively fired at 700° C. to 800° C., after which a binder, PVA, or another organic substance is added and the resulting mixture is kneaded. The mixture is then heated at 300° C. to 500° C. to remove the binder, and finally fired at 1100° C. to 1300° C. The resulting substance is machined to prescribed dimensions, after which an electrode is formed on its surface by plating, baking, vapor deposition, or the like.

To complete polarization, a DC voltage of 2 to 3 kV/mm is applied across the electrode in insulating oil heated at about 100° C., for several tens of minutes.

A PVDF piezoelectric film is formed by performing polarization on a uniaxially oriented film of vinylidene fluoride resin at a high voltage. The PVDF piezoelectric film has a low piezoelectric distortion constant, which is one-fifth or less the piezoelectric distortion constant of PZT piezoelectric ceramics, but can have a large area and can be thinned.

Patent Document 4 discloses that an AC voltage is applied to a cantilever piezoelectric bimorph element formed with a piezoelectric film so that resonance is mechanically caused and a free end of the piezoelectric bimorph element is vibrated so as to cause an air flow, which is used as a source of an air flow to a thermistor and the like. An apparatus disclosed in Patent Document 5 has a plurality of cantilever piezoelectric bimorph elements, each of which has a wire at its end and performs printing independently by pressing an ink ribbon against a recording medium according to print signals. Patent Document 6 discloses a structure in which both ends are supported to enable a piezoelectric bimorph element to be used in a touch panel.

The structure in which a plurality of bimorph actuators are disposed in the width direction has the same problem as in the conventional structure which uses a resonator formed by combining an ultrasonic piezoelectric cell and a horn; vibration cannot be applied to a toner image supporting body between adjacent actuators. To address this problem, in the present invention, a vibrating unit that uses an actuator adaptable to a wide width is devised.

Figure 4:
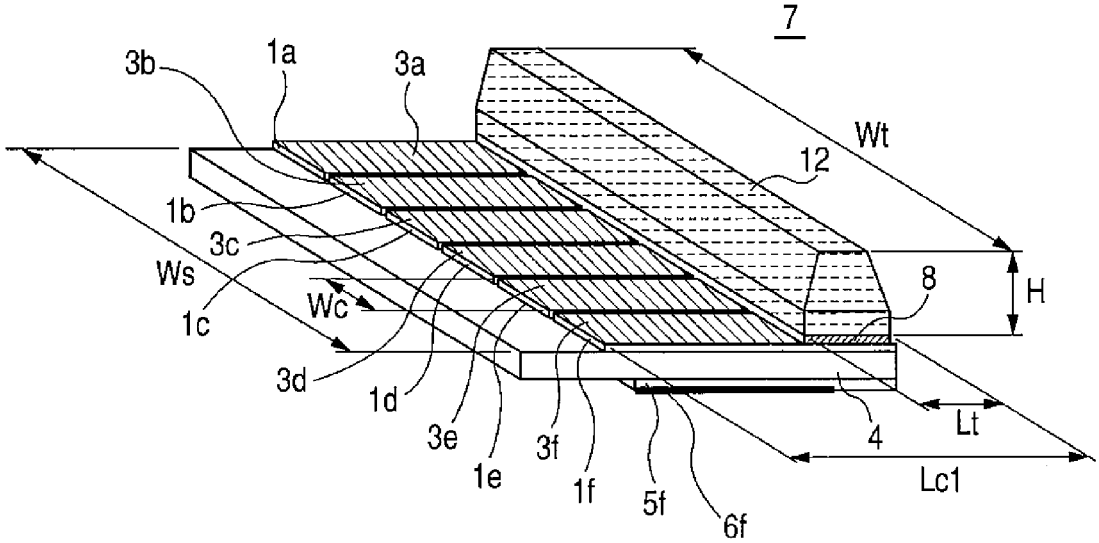
FIG. 4 is a perspective view of a structural diagram illustrating a piezoelectric bimorph element.

FIG. 4 illustrates the basic structure of a bimorph actuator according to the present invention. The shim member 4 is made of, for example, a stainless, phosphor bronze, or titanium sheet with a thickness of 50 to 300 μm or a carbon fabric sheet formed by impregnating epoxy resin into carbon fabric oriented in one direction. The width Ws of the shim member 4 is equal to or more than printing width Wp. It will be assumed here that the width Wp of the shim member 4 is 20 inches (508 mm). Six piezoelectric bodies 1*a*, 1*b*, 1*c*, 1*d*, 1*e*, and 1*f* with a length of Lc1 and a width of Wc (80 mm) are bonded to the front surface of the shim member 4 with a conductive adhesive, and another six piezoelectric bodies 5*a*, 5*b*, 5*c*, 5*d*, 5*e*, and 5*f* are similarly bonded to the backside. A slight spacing may be provided between adjacent piezoelectric bodies when they are bonded.

Figure 8A:
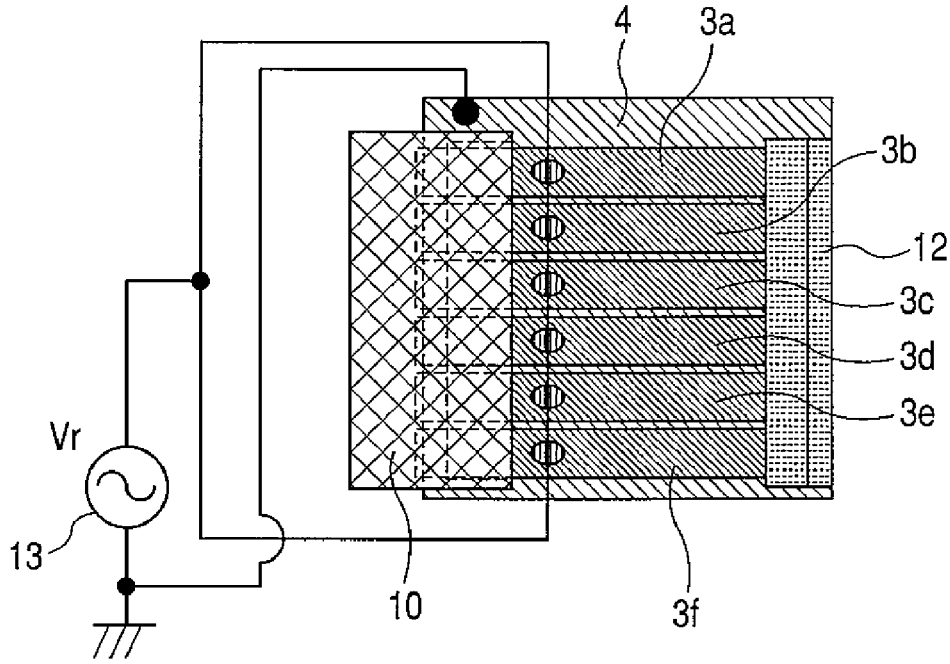
FIG. 8A is a structural plan diagram illustrating a vibrating unit using a piezoelectric bimorph element.
Figure 8B:
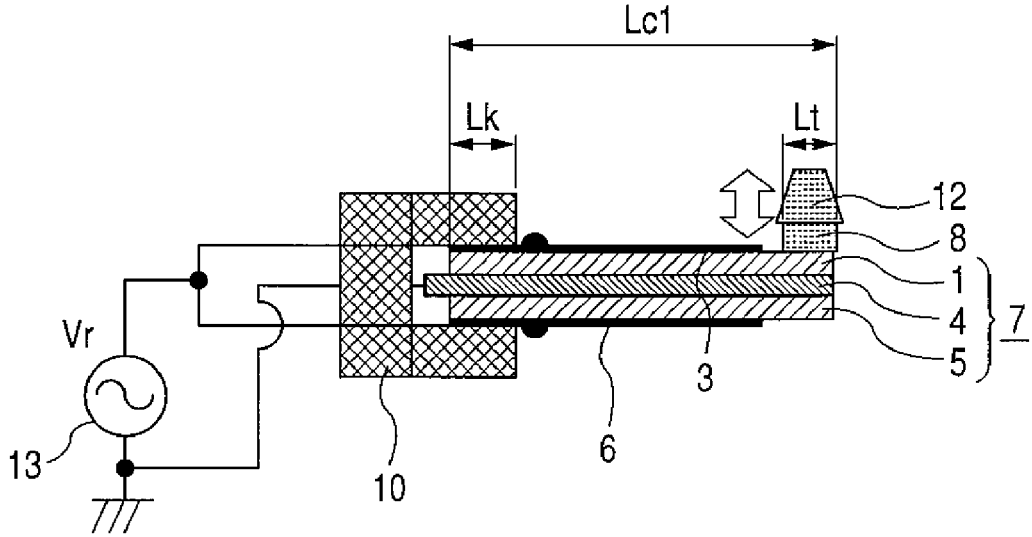
FIG. 8B is a cross sectional view of the vibrating unit shown in FIG. 8A.

The width of the electrodes 3 and 6 is (Lc1−Lt). A protrusion portion 12 made of metal or resin with a length of Lt, a width of Wt and a height of H is bonded and fixed to an area at one end of the piezoelectric body 1, 5, with a width of Lt, in which no electrode is formed, by using an isolative adhesive 8. The width Wt of the protrusion portion 12 is equal to or more than the printing width Wp and equal to or less than the width Ws of the shim member 4. A plurality of electrodes 3*a* to 3*f* and another plurality of electrodes 6*a* to 6*f* formed on the surfaces of the piezoelectric bodies 1*a* to 1*f* and 5*a* to 5*f* connected collectively to an electrode terminal. Thus, a piezoelectric bimorph element 7, which is wide and is formed as an integrated type, is composed. Its structure is illustrated in FIG. 8(*a*).

A key point in this structure is that areas with a width of Lt on the piezoelectric bodies 1, 5, to one of which the protrusion portion 12 is bonded and fixed, do not include the electrodes 3 and 6. This is because if the electrodes 3 and 6 are included in these areas, the areas also become active areas that expand and contract and thereby would otherwise cause interfacial peeling due to a shearing stress exerted on the bonded interface between the piezoelectric body 1 and the protrusion portion 12. These areas free from electrodes will be referred to below as inactive areas (dummy areas).

A method of making an area inactive is to prevent the electrode 3 or 6 from being included in the area. In another method, the area is excluded from polarization in the polarization process.

As seen from equations (3) and (4), the displacement U and resonant frequency f depend on the length L and thickness $t_t$ of the piezoelectric element. The contraction and expansion when a voltage is applied to the piezoelectric elements bonded to both sides of the shim member 4 exhibit a function of the piezoelectric bimorph element 7, causing the protrusion portion 12 disposed at the end of the piezoelectric body 1 to vibrate up and down. The piezoelectric bimorph element 7 having this structure is ready for a wide width and does not raise the mutual interference problem involved in the use of the conventional ultrasonic oscillator.

Figure 5:
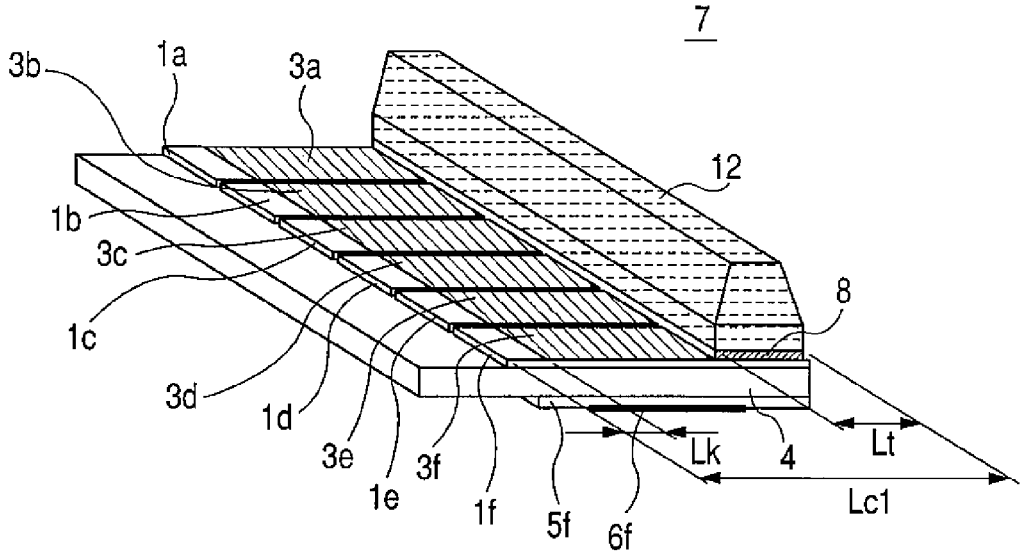
FIG. 5 is a perspective view of a structural diagram illustrating another piezoelectric bimorph element.

FIG. 5 illustrates the basic structure of another bimorph actuator different from FIG. 4. This bimorph actuator differs from the bimorph actuator in FIG. 4 in that the area in which an electrode is formed on the surface of the piezoelectric element is narrowed. An area, with a width of Lk, corresponding to a supporting and fixing area in a structure for supporting the piezoelectric bimorph element 7 at one end, as shown in FIG. 8(*b*), is used as a dummy area in which the driving electrode 3 or 6 is not included. This prevents a shearing stress exerted from being generated between the supporting and fixing member 10 and the piezoelectric body 1, 5, and thereby prevents the piezoelectric body 1, 5 from being mechanically damaged.

Figure 6:
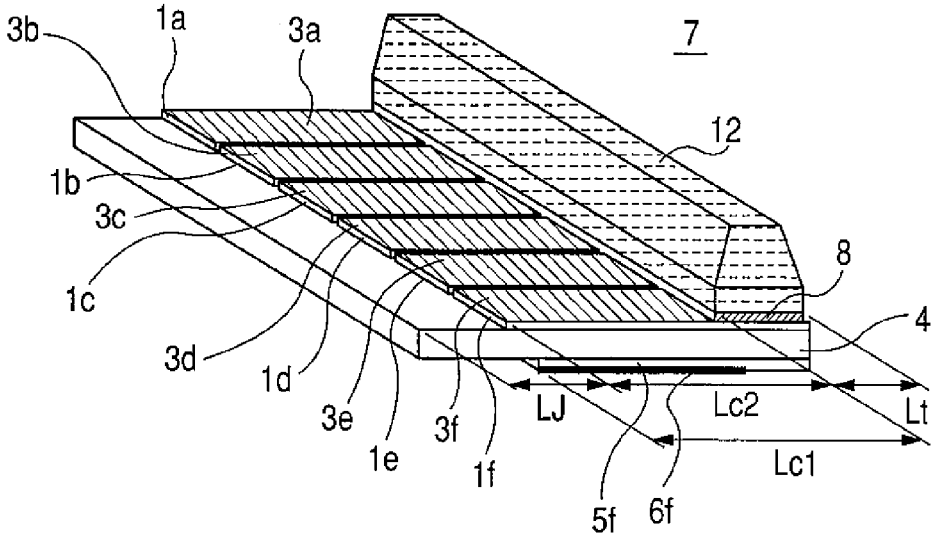
FIG. 6 is a perspective view of a structural diagram illustrating yet another piezoelectric bimorph element.

FIG. 6 illustrates the structure of a yet another bimorph actuator. It differs from the structure in FIG. 4 in that the lengths of the piezoelectric bodies 1*a* to 1*f* bonded to the front surface of the shim member 4 are shortened. The length Lc2 of the piezoelectric body 1*a* to 1*f* is shorter than Lc1 by Lt. The length of the lower piezoelectric bodies 5*a* to 5*f* (5*a* to 5*e* are hidden) remain at Lc1. An end of the shim member 4 is thereby exposed on the front surface. The protrusion portion 12 is directly fixed to the exposed area on the front surface of the shim member 4 with an adhesive 8.

Figure 7:
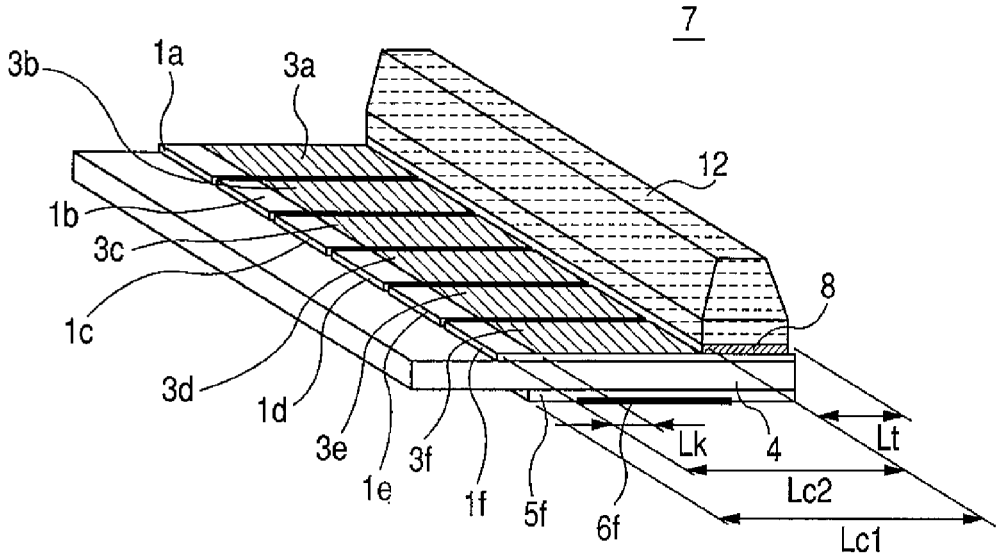
FIG. 7 is a perspective view of a structural diagram illustrating still another piezoelectric bimorph element.

FIG. 7 illustrates the structure of a still another bimorph actuator. It differs from the structure in FIG. 4, as with the structure in FIG. 5, in that an area, with a width of Lk, corresponding to a supporting and fixing area in a structure for supporting the piezoelectric bimorph element 7 at one end is eliminated from the electrode 3 or 6 formed on the surface of the piezoelectric body 1, 5. The structures in FIGS. 6 and 7 have the advantage of lightening the piezoelectric body by the amount by which the piezoelectric body 1, 5 is shortened. Although the length of the piezoelectric body 5 bonded to the backside of the shim member 4 is Lc1 here, the length may be Lc2, which is the length of the piezoelectric body 1 on the front surface. In this case, the thickness of the shim member 4 should be increased to increase its strength.

FIG. 8(*a*) is a plan view illustrating a vibrating unit that uses the piezoelectric bimorph element in the present invention. The piezoelectric bimorph element 7 used is structured as illustrated in FIG. 4. The piezoelectric distortion constant $d_{31}$ of the PZT piezoelectric body 1, 5 used is $110\times10^{-12}$ (c/N), the Young's modulus Y is $6.96\times10^{10}$ N/m$^2$, and the density ρ is $7.5\times10^3$ kg/m$^3$. The PZT plates 1 and 5 have a thickness t of 300 μm, a width Wc of 80 mm, and a length Lc1 of 20 mm. A stainless plate with a thickness of 50 μm is used as the shim member 4. The PZT plates 1 and 5 are bonded to both sides of the shim member 4 with an adhesive. Apparent thickness $t_s$ of the shim member 4, including the adhesive layer 8, is 100 μm. Lt is 5 mm. The length (Lc1−Lt) of the area in which to form an electrode is 15 mm. The width Lk of the area corresponding to the supporting and fixing area in the cantilever structure is 10 mm. The protrusion portion 12 is formed by machining an aluminum material. The electrodes 3*a* to 3*f* on the PZT plates 1*a* to 1*f* were drawn together with conductive paste; the electrodes 6*a* to 6*f* on the PZT plates 5*a* to 5*f* were also drawn together with conductive paste. The piezoelectric bimorph element 7 was seated in the width Lk of the supporting and fixing member 10. The width Lk is 10 mm and the vibration length L (=Lc1−Lk) of the piezoelectric body 1, 5 is also 10 mm.

FIG. 8(*b*) is a side view of the vibrating unit. The electrode terminals of the actuator are connected to an AC power supply 13. A driving wave Vr was an AC sine wave with a peak value of ±30 V. The vibration displacement at the top of the protrusion portion 12 was measured with a laser displacement meter at different driving frequencies. According to measurement results, the vibration amplitude is maximized at a resonant frequency f of 3 kHz, and the displacement U is 4 μm. These values approximately match the values derived from equations (3) and (4) (resonant frequency f=3.5 kHz and displacement U=4.6 μm) The driving wave was then changed to an AC rectangular wave with a peak value of ±30 V. It was found that the resonant frequency f remained unchanged, but the displacement was increased to 5 μm. As a factor for this, it can be estimated that the AC rectangular wave has a larger voltage leading edge dV/dt and uses a larger energy supplied than the AC sine wave. In FIGS. 8(*a*) and 8(*b*) as well, the piezoelectric bimorph element 7 shown in FIGS. 5 and 7 can be used. In the structure in FIGS. 5 and 7, the fixing member 10 holds the dummy area with a width of Lk in which no electrode is included, so the advantage of preventing the piezoelectric body from being damaged in a long period of driving is obtained.

Figure 9A:
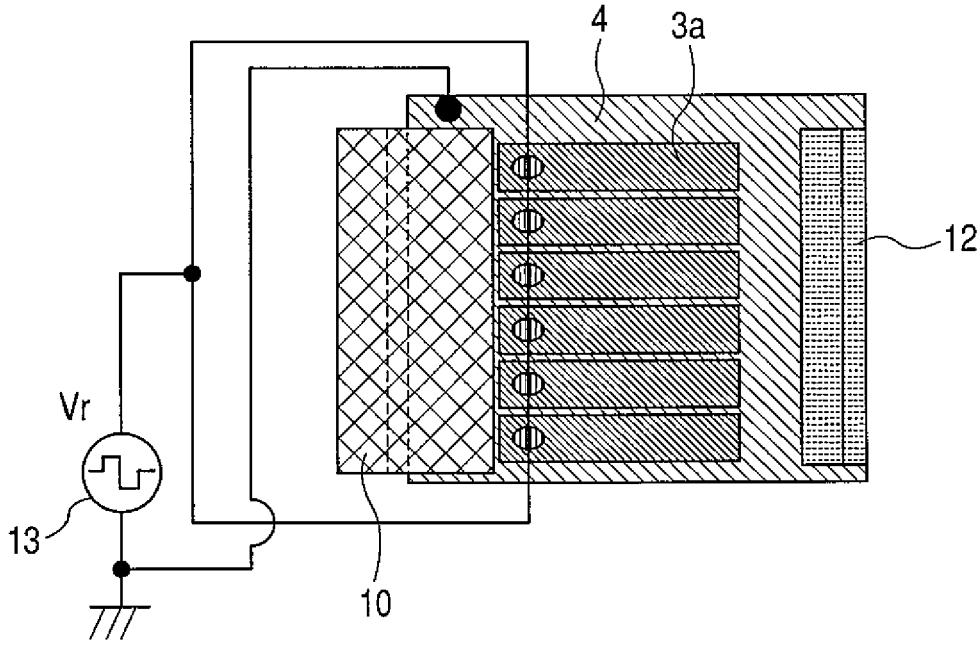
FIG. 9A is a structural diagram illustrating another vibrating unit using a piezoelectric bimorph element.
Figure 9B:
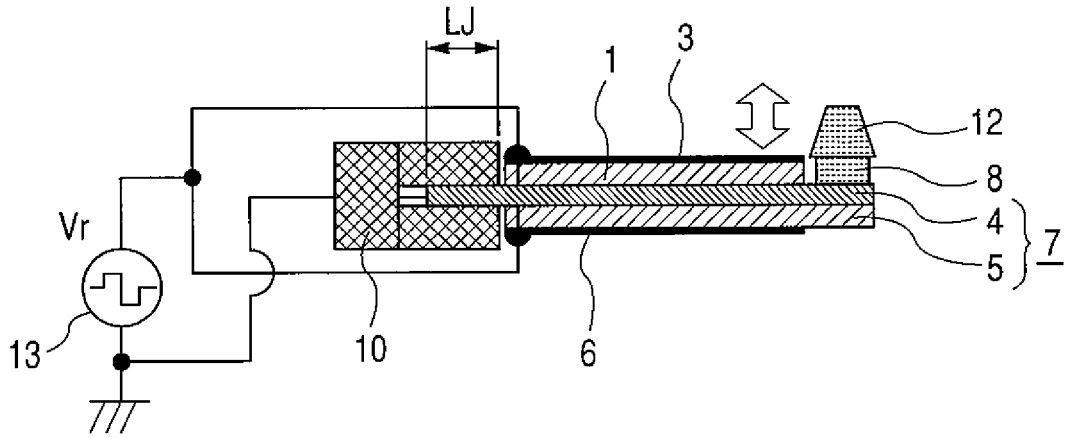
FIG. 9B is a cross sectional view of the vibrating unit shown in FIG. 9A.

FIGS. 9(*a*) and 9(*b*) illustrate another vibrating unit that uses the piezoelectric bimorph element in the present invention. The piezoelectric bimorph element 7 used is structured as illustrated in FIG. 6. The length LJ of an area, on the shim member 4, in which the piezoelectric bodies 1 and 5 are not bonded, is 10 mm. Lc2 is 5 mm. The fixing member 10 directly holds the area with a length of LJ on the shim member 4 in the piezoelectric bimorph element 7. The shim member 4 vibrates with one end being held. Mechanical stress, on which the life of the vibrating unit depends, is applied to the shim member 4 rather than the piezoelectric body 1, 5. Since the shim member 4 is an elastic body, it is more resistant to bending stress than PZT ceramics, prolonging the life.

Figure 10A:
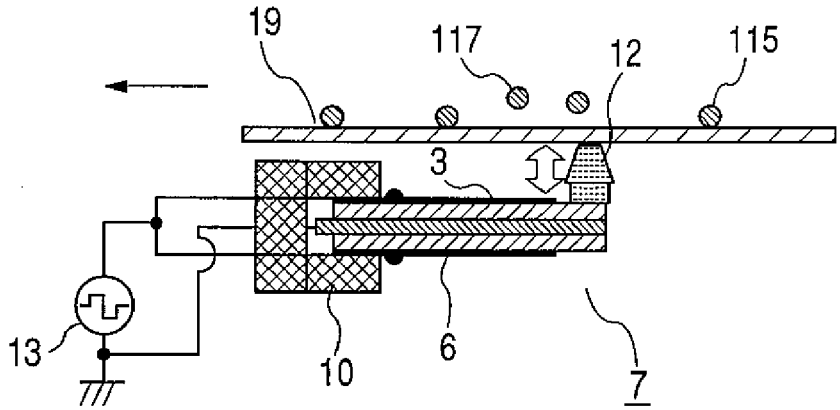
FIG. 10A is a schematic view of vibrating unit used in the test.
Figure 10B:
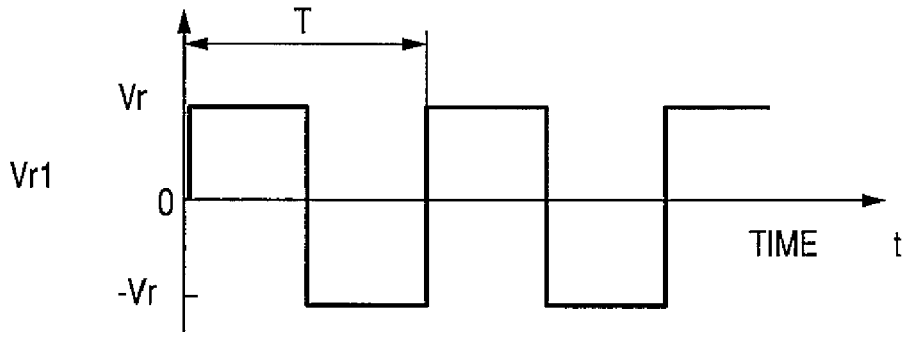
FIG. 10B and FIG. 10C are drawings illustrating the characteristics of vibration applied to a belt by a vibrating unit using a piezoelectric bimorph element.
Figure 10C:
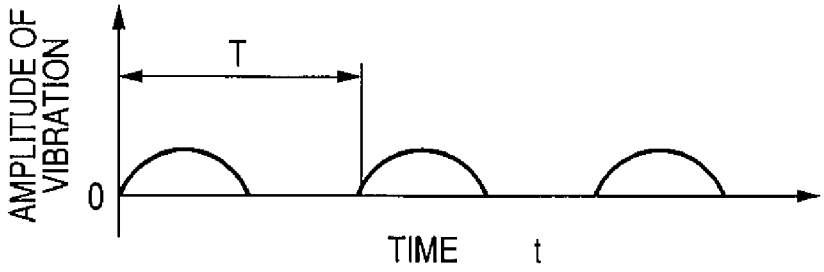
Figure 11A:
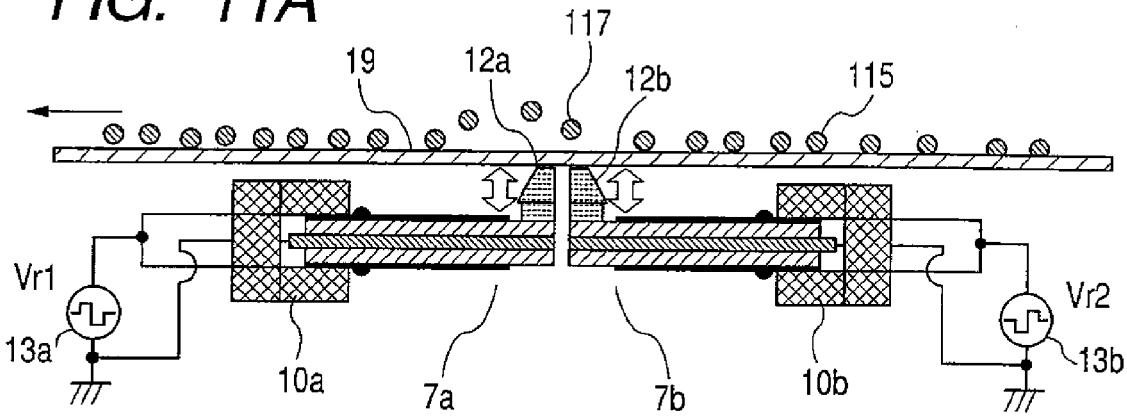
FIG. 11A is a schematic view of vibrating unit used in the test.
Figure 11B:
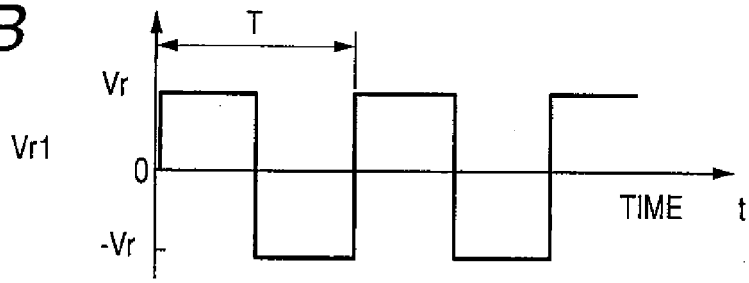
FIGS. 11B to 11D are drawings illustrating the characteristics of vibration applied to a belt by another vibrating unit using a piezoelectric bimorph element.
Figure 11C:
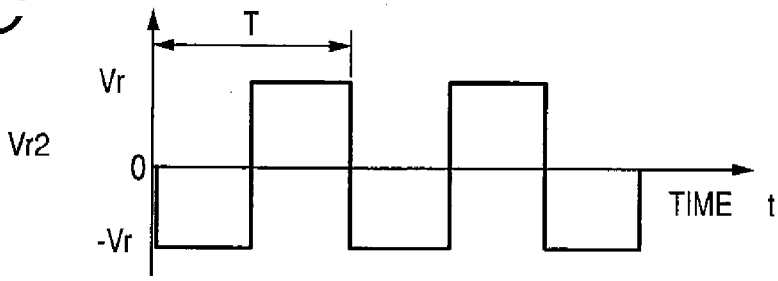
Figure 11D:
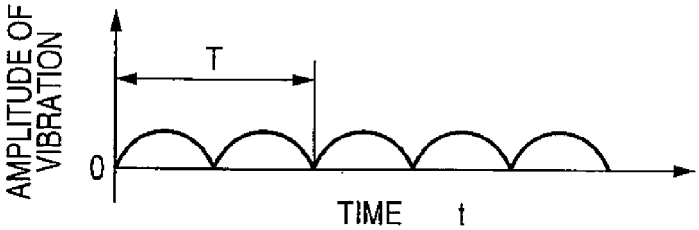

FIGS. 10(*a*) to 10(*c*) illustrate characteristics of vibration applied by the vibrating unit to the toner image supporting belt 19. FIG. 10(*a*) illustrates a state in which the toner image supporting belt 19 on which a toner image is formed is running. The piezoelectric bimorph element 7 is installed on the back of the toner image supporting belt 19. When the protrusion portion 12 vibrates up and down, vibration energy is applied to the back of the toner image supporting belt 19. FIG. 10(*b*) illustrates a driving voltage waveform, and FIG. 10(*c*) illustrates how the vibration amplitude (displacement U) of the toner image supporting belt 19 changes with time. When the toner image supporting belt 19 is raised upward, an inertia force $F_B$ acts on the toner 115, 117 reducing the force of bonding to the surface of the toner image supporting body. If the vibration frequency of the piezoelectric bimorph element 7 is f (Hz), a period during which the toner image supporting belt 19 is raised is half one cycle (T), that is, 1/(2f) seconds.

The actuator illustrated in FIGS. 8(*a*) and 8(*b*) is driven at a resonant frequency of 3 kHz. Assume that the print density of the toner image is 600 dpi and also simply assume that it is enough that one vibration is applied to the toner. It is then possible to keep up with up to a print speed of about 5 ips (inches per second). To further increase the speed and precision, the period (lift cycle) during which the toner image supporting belt 19 is raised needs to be prolonged. In the case of color printing, toner forms a plurality of layers, requiring larger inertia force $F_B$ to be applied. Since the inertia force $F_B$ is proportional to the vibration amplitude and vibration frequency, when the lift cycle is shortened, the inertia force is increased.

As seen from equations (3) and (4), this problem can be solved from the viewpoint of design by selecting a piezoelectric material having a large piezoelectric distortion constant $d_{31}$ and a large Young's modulus Y and by making the dimensions of constituents appropriate. Another solution is derived from the structure of the vibrating unit.

FIG. 11(*a*) illustrates the structure of a vibrating unit using two bimorph actuators. In this drawing, two piezoelectric bimorph elements 7*a* and 7*b* are disposed so that their protrusion potions 12*a* and 12*b* are brought close to each other. The piezoelectric bimorph elements 7*a* and 7*b* are respectively driven by AC power supplies Vr1 and Vr2. As seen from FIGS. 11(*b*) and 11(*c*), the power supplies Vr1 and Vr2 are characterized in that their phases are shifted by a ½ cycle from each other. While the piezoelectric bimorph element 7*a* is raising the toner image supporting belt 19, the piezoelectric bimorph element 7*b* is lowered and does not touch the toner image supporting belt 19. While the piezoelectric bimorph element 7*a* is under the toner image supporting belt 19, the piezoelectric bimorph element 7*b* raises the toner image supporting belt 19. Accordingly, the toner image supporting belt 19 receives vibration energy with a pulse-like amplitude as shown in FIG. 11(*d*), by which the inertia force $F_B$ is applied to the toner 115, 117 on the toner image supporting belt 19. As a result, the period during which the inertia force is applied to the toner 115, 117 can be doubled as compared with the structure in FIG. 10.

When the piezoelectric bimorph element 7 is used in the image forming apparatus, it is important to assure life and reliability necessary for a device as well as its vibration characteristics (vibration amplitude and vibration frequency). Since the piezoelectric bimorph element 7 is used in a cantilever structure, it is necessary to prevent mechanical stress from being applied to the supporting and fixing part and the joint of the protrusion potion 12*a*, 12*b*, which provides a contact with the toner image supporting belt 19. Therefore, areas with which the supporting and fixing part and the joint of the protrusion portion 12*a*, 12*b* are brought into contact are preferably inactive; the structures illustrated in FIGS. 5 and 7 are best, in which those areas on the piezoelectric bodies 1, 5 do not include electrodes 3, 6. The piezoelectric bimorph element 7 has a laminate structure including piezoelectric bodies 1, 5 and a shim member 4, in which the piezoelectric bodies 1, 5 are bonded to the shim member 4 with an adhesive 8; to eliminate the need to increase the driving voltage, a conductive adhesive is preferably used.

Next, problems when a piezoelectric bimorph element having a conventional structure is used as a vibrating mechanism for providing vibration energy, which is on object of the present invention, will be described.

Figure 21:
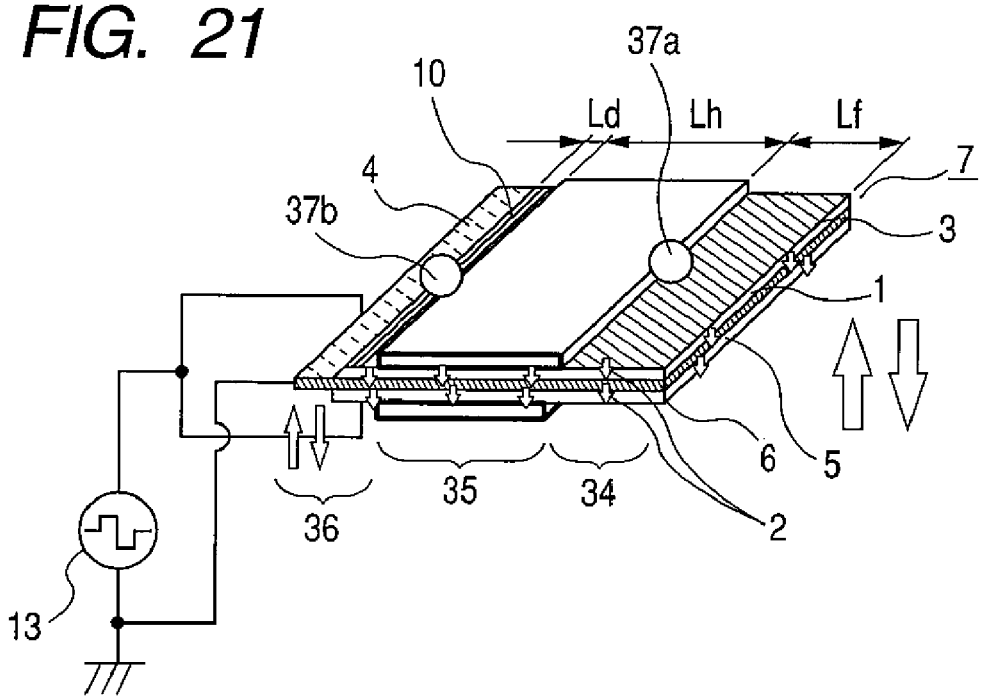
FIG. 21 is a perspective view illustrating the structure of a transfer apparatus that uses a conventional piezoelectric bimorph element as the vibrating means.

FIG. 21 illustrates the structure of a transfer unit that uses a conventional piezoelectric bimorph element as a vibrating means. The piezoelectric bimorph element 7 has a laminated structure in which the shim member 4 is held between the piezoelectric bodies 1 and 5 over which the electrodes 3 and 6 are respectively formed. The electrodes 3 and 6 are formed to polarize the piezoelectric bodies. On the piezoelectric bimorph element 7, an area 35 is fixed from above and below by fixing members 10*a* and 10*b*, an area 34 is a free end area that retrieves vibration energy caused by up and down vibration when a voltage is applied, and an area 36 is a power supply terminal connecting part for supplying electric power to the electrodes 3 and 6 on the surfaces of the piezoelectric bodies 1 and 5. When the AC power supply 13 applies an AC voltage across the electrode 3 and the shim member 4 and across the electrode 6 and the shim member 4, the free end area 34 vibrates up and down, as indicated by the arrows. The displacement $U_1$ and resonant frequency $f_1$ at that time are derived from equations (3) and (4) by substituting $L_f$ for L.

Since a voltage is applied over the entire piezoelectric body 1, 5, the areas 35 and 36 also undergo distortion (stress) proportional to the strength of the electric field due to the reverse piezoelectric effect. Although the purpose of the fixing member is to hold the area 35, which vibrates up and down, areas, on the piezoelectric body 1, 5, near both sides 37*a* and 37*b* of the fixing member repeatedly undergo a large stress at the driving frequency. The area 36 also vibrates up and down, the frequency being smaller than in the area 34. The displacement U and resonant frequency $f_2$ at that time are derived from equations (3) and (4) by substituting $L_d$ for L. Since $L_f$ is larger than $L_d$, $f_1$ becomes smaller than $f_2$. Therefore, vibration at a high frequency ($f_2$) is superimposed on vibration ($f_1$) in the free end area 34.

The piezoelectric bimorph element 7 illustrated in FIG. 21 can be used to add vibration energy to the backside of the toner image supporting body 38 and thereby give the inertia force $F_B$ to the toner so as to reduce the force of bonding between the toner and the toner image supporting body 38. This process will be considered below. The inertia force $F_B$ is given from equation (5).

$$F_B=4\pi^2 f^2 \cdot U \cdot m(N) \tag{5}$$

where f is the vibration frequency of the piezoelectric bimorph element 7, and m is the weight of a single toner particle.

As seen from equation (5), $F_B$ is proportional to the square of the vibration frequency f and the displacement U. Accordingly, the conventional piezoelectric bimorph element has problems described below.

(a) Since the vibration of the area 36 (power supply terminal connecting part) is superimposed to the up and down vibration in the area 34 (free end area), the vibration characteristics in the area 34 is in a non-uniform vibration mode, worsening the vibration characteristics of the vibrating means used as a vibration source. (b) To increase the inertia force $F_B$, both the vibration frequency f and the displacement U need to be increased. However, the stress is then increased, causing a reliability problem such as damage to the piezoelectric body.

To address these problems, the electrodes 3, 6 bonded to the surfaces of the piezoelectric bodies 1 and 5 and the shim member 4 are shaped so that when a voltage is applied to the piezoelectric bimorph element 7, the reverse piezoelectric effect is exerted only on the area 34, in which free vibration occurs.

FIGS. 19(*a*-1) to 19(*d*) illustrate the structure of the piezoelectric bimorph element in the present invention. FIGS. 19(*a*-1) and 19(*a*-2) illustrate the shape of the upper piezoelectric body 1 in the piezoelectric bimorph element and the shapes of the electrodes formed on the surfaces of the piezoelectric body 1; the electrode 3*a* in FIG. 19(*a*-1) is L-shaped and formed on the front surface, and the electrode 3*b* in FIG. 19(*a*-2) is rectangular and is formed on the backside. As explained in the description of the method of fabricating the PZT piezoelectric body, these shapes are obtained by leaving the electrode areas 3*a* and 3*b* and removing the rest from the electrodes, as shown in FIGS. 19(*a*-1) and 19(*a*-2), after polarization of a sintered PZT plate, the plates being formed over the entire areas on both surfaces of the piezoelectric body 1 for polarization.

The polarization 2 is performed over the entire area, including parts lacking electrodes, in the thickness direction. The electrodes 3*a* and 3*b* were initially formed on both sides of the piezoelectric body 1 and polarization processing was performed. In this method, it was found that large distortion occurred between a polarized area and a non-polarized area and a crack was generated. So, the method was changed to the above method.

FIGS. 19(*c*-1) and 19(*c*-2) also illustrate the shape of the lower piezoelectric body 5 in the piezoelectric bimorph element and the shapes of the electrodes 6*a*, 6*b* formed on the surfaces of the piezoelectric body 5; the electrode 6*a* in 4C-1 is rectangular and is formed on the front surface, and the electrode 6*b* in FIG. 19(*c*-2) is L-shaped and formed on the backside. FIG. 19(*b*) illustrates the shape of the shim member 4, which is T-shaped. A shim member made of a stainless or phosphor bronze is used as the shim member 4.

FIG. 19(*d*) illustrates the shape of the piezoelectric bimorph element 7 formed by laminating the piezoelectric body 1, shim member 4, and piezoelectric body 5 by bonding them in that order with an adhesive. A conductive adhesive 8 is used on both sides of the area 4*a* on the T-shaped shim member 4 so that an electrical continuity is established between the electrode 3*b* on the piezoelectric body 1 and the electrode 6*a* on the piezoelectric body 5. An isolative adhesive 9 is used on the rest 4*b* of the shim member 4 (areas excluding the electrode 3*b* on the backside of the piezoelectric body 1 and the electrode 6*a* on the front surface of the piezoelectric body 5). The area 3*a*L is the power supply terminal connecting part connected to the electrode 3*a* on the piezoelectric body 1, and the area 6*b*L is the power supply terminal connecting part connected to the electrode 6*b* on the piezoelectric body 5. The area 4*b* is a power supply terminal connecting part connected to the shim member 4.

Figure 20:
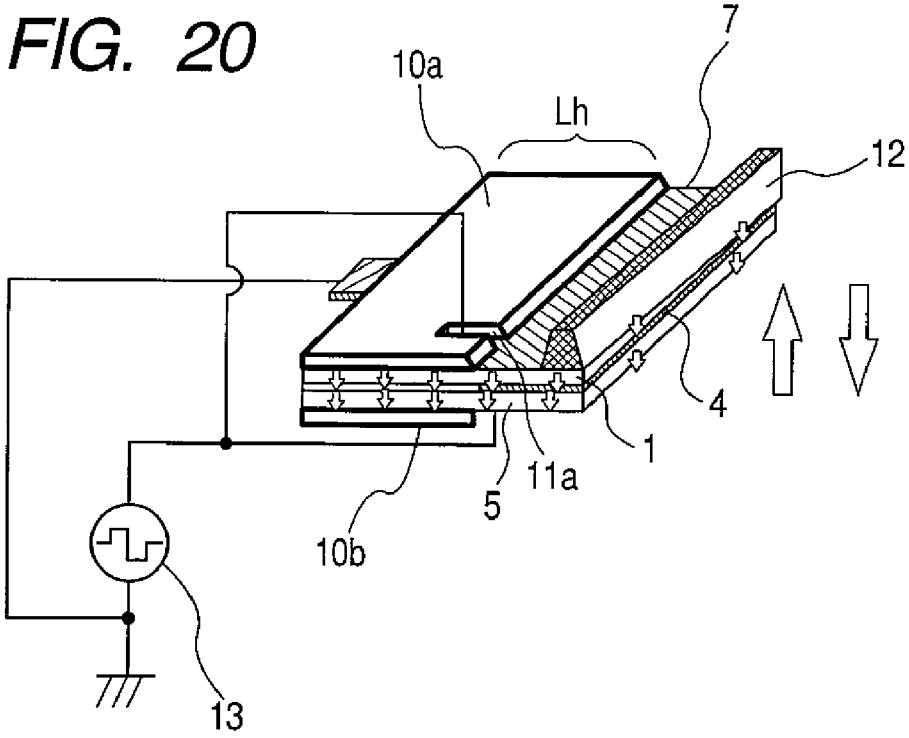
FIG. 20 is a structural perspective diagram illustrating the vibrating means that uses the piezoelectric body of the present invention.

FIG. 20 illustrates a vibrating means with a cantilever structure that uses the piezoelectric bimorph element 7 illustrated in FIG. 19(*d*). The width Lh of the supporting and fixing members 10*a* and 10*b* matches the width Lh of the piezoelectric bimorph element 7. A notch 11*a* is formed at part of the supporting and fixing member 10*a*, through which a power supply terminal is connected to the electrode area 3*a*L using conductive paste. Similarly, a notch 11*b* is formed at part of the supporting and fixing member 10*b*, through which another power supply terminal is connected to the electrode area 6*b*L.

A protrusion portion 12 is bonded to the front surface of the free end of the piezoelectric body 1 so that the vibration energy of the piezoelectric bimorph element 7 is applied to the backside of the toner image supporting body. Since a voltage is applied to the power supply terminals of the piezoelectric bimorph element 7 from the AC power supply 13, the protrusion portion 12 vibrates up and down. The AC power supply 13 supplies a voltage of ± tens of volts at several kilohertz or less, and its power consumption is several watts or less.

To improve corona transfer performance by using the vibrating means in which the piezoelectric bimorph element 7 is employed, it is important to obtain stable vibration (a uniform vibration amplitude and uniform vibration frequency) and reliability including the life of the piezoelectric bimorph element 7.

When the piezoelectric bodies 1 and 5 are bonded to the shim member 4 in a laminated structure in FIGS. 19(*a*-1) to 19(*d*), only one type of adhesive (isolative adhesive or conductive adhesive) may be used. However, a problem described below is raised.

When an isolative adhesive is used, the voltage applied to the piezoelectric bodies 1 and 5 is reduced substantially because part of the applied voltage is shared by a bonding layer 8 in the area 34 (free end area). As seen from equation (3), the displacement U is then reduced. When a conductive adhesive is used, the shim member 4 is spread over the entire surface substantially, so the above problem at the area 34 is solved; however, a voltage is applied to the piezoelectric bodies 1 and 5 at the power supply terminal connecting parts, and thus distortion occurs due to the reverse piezoelectric effect. Accordingly, there is a risk that the piezoelectric bodies 1 and 5 may be damaged around the notches 11 during vibration.

In the best mode of the present invention, an isolative adhesive is used in the area 35 fixed with the fixing member, and a conductive adhesive is used in the area 34 (vibrating area). It is preferable to select adhesive compositions and adhesive application conditions so that after curing, both adhesive layers 8 have the same thickness and their glass transition temperatures and hardness are approximately the same.

As described above, the transfer apparatus in the invention comprises a corona transfer means 18, which faces a toner image supporting body 19, and a vibrating means 25 for applying vibration energy to the backside of the toner image supporting body 19 at a position opposite to the corona transfer means 18; the transfer apparatus electrostatically transfers a toner image on the intermediate transfer belt 19 to a recording medium. The vibrating means 25 has a cantilever structure, that is, it holds one end of a piezoelectric bimorph element 7 structured so that paired piezoelectric bodies 1 and 5, on the surfaces on which electrodes 3 and 6 are formed, are bonded to both sides of a conductive elastic body 4, a protrusion portion 12 being provided on the other end. When a voltage is applied across the electrode 3 on the piezoelectric body 1 and the shim member 4 and across the electrode 6 on the piezoelectric body 5 and the shim member 4, no voltage is applied to areas, on the piezoelectric bodies 1 and 5, in which the piezoelectric bimorph element 7 is supported. That is, the electrodes 3, 6 are not installed on the piezoelectric bodies 1 and 5, in which the piezoelectric bimorph element 7 is supported.

Further, the transfer apparatus in the invention uses the mechanical vibration of a bimorph element that employs the transverse vibration ($d_{31}$ mode) of a piezoelectric body, and can thereby transfer a toner image uniformly over a large area. The vibrating unit of the transfer apparatus can be made compact and consume less power when compared with a method in which a horn and an ultrasonic oscillator that uses the longitudinal vibration ($d_{33}$ mode) of a conventional piezoelectric body are combined. Accordingly, the image forming apparatus that uses the transfer apparatus in the invention can perform high-quality printing on various types of paper and wide paper that has not been able to be handled by the conventional electrophotographic method, and can deal with printing on roughened surface paper, double-sided printing, and printing on embossed paper.

First Embodiment

FIG. 1 illustrates the structure of a transfer apparatus in a first embodiment of the present invention, in which a toner image made of toner 115, 117 and formed on the OPC photosensitive belt 19 is transferred to roughened surface paper or a second surface used in double-sided printing. The paper 16 includes a void 17 with a depth of 20 to 30 μm and a width of 50 to 100 μm on the surface. The toner 115, 117 is negatively charged; its particle is 9 μm in diameter. The transfer apparatus is a continuous paper printer with a process speed (vector movement speed) of 23 ips; it adapts to paper 16 with a width of 20.5 inches, the printing width being 19.5 inches. The vibrating unit is formed by changing the piezoelectric bimorph element 7 illustrated in FIG. 5 to the cantilever structure illustrated in FIGS. 8(*a*) and 8(*b*). During non-driving, the protrusion portion 12 is apart from the backside of the belt 11. The shim member 4 of the piezoelectric bimorph element 7 is a stainless plate with a thickness of 50 μm, a width of 560 mm, and a length of 25 mm. Six PZT plates 1 are bonded and fixed to one surface of the shim member 4 with an epoxy conductive resin, and another six plates 5 are similarly bonded to the other surface; the PZT plate has a thickness t of 200 μm, a width Wc of 80 mm, and a length Lc1 of20 mm. The total thickness of the resulting laminate body is 500 μm. The protrusion portion 12 is integrally formed with aluminum, and bonded and fixed to an end of the piezoelectric body 1 and 5, on which no electrode is formed, with an epoxy resin adhesive.

The AC power supply 13, which is an AC power supply for supplying rectangular waves, is used to apply an AC voltage across the piezoelectric body 1 on the electrode 3 and the shim member 4 and across the piezoelectric body 5 on the electrode 6 and the shim member 4. A corona transfer unit 18 connected to a DC high-voltage power supply 113 is disposed on the backside of the paper 16. Positive corona charges are applied to the back of the paper 16 and an electrostatic force $F_E$ acts on the toner in an area facing the corona transfer unit 18. A mirror image force $F_M$ and van der Waals's force $F_f$ act across the toner and the photosensitive belt 19 as an adherence force. The strength of the mirror force $F_M$ varies with the amount of charge on the toner. The strength of the van der Waals's force $F_f$ varies with the state of the surface of the toner. Silica adheres to the surface of the toner as an external additive. When the coverage is 25%, which is the value of the coverage of ordinary external additives, $F_F$ is about 10 nN. Since the mirror force $F_M$ is an electrostatic adherence force, when the electrostatic force $F_E$ produced by the corona transfer unit 18 is enlarged, it becomes possible to overcome the mirror image force $F_M$. The van der Waals's force $F_f$ is a non-electrostatic adherence force. When a rectangular wave AC voltage with a frequency of 5 kHz and a peak value of ±40 V was applied to the piezoelectric bimorph element 7 during printing, the protrusion portion 12 vibrated up and down with amplitude of about 18 μm. An inertia force $F_B$ of 11 nN then acted on the toner 115 on the belt. This value is greater than the van der Waals's force $F_F$. It was then found that the toner 115 is released from a constraint by the mirror image force and the van der Waals's force due to the electrostatic force $F_E$ and inertia force $F_B$, and flies in the concave 17 as a toner 117, and that the toner 117 can be thereby transferred to the paper 16 with large concaves and convexes on the front surface. This embodiment has been described for a case in which continuous form is used as the paper 16, but it should be understood that the same advantage can be obtained for cut sheets. Although the piezoelectric bimorph element 7 structured shown in FIG. 5 is used, it may be structured as shown in FIGS. 4, 6, and 7.

Second Embodiment

Figure 2:
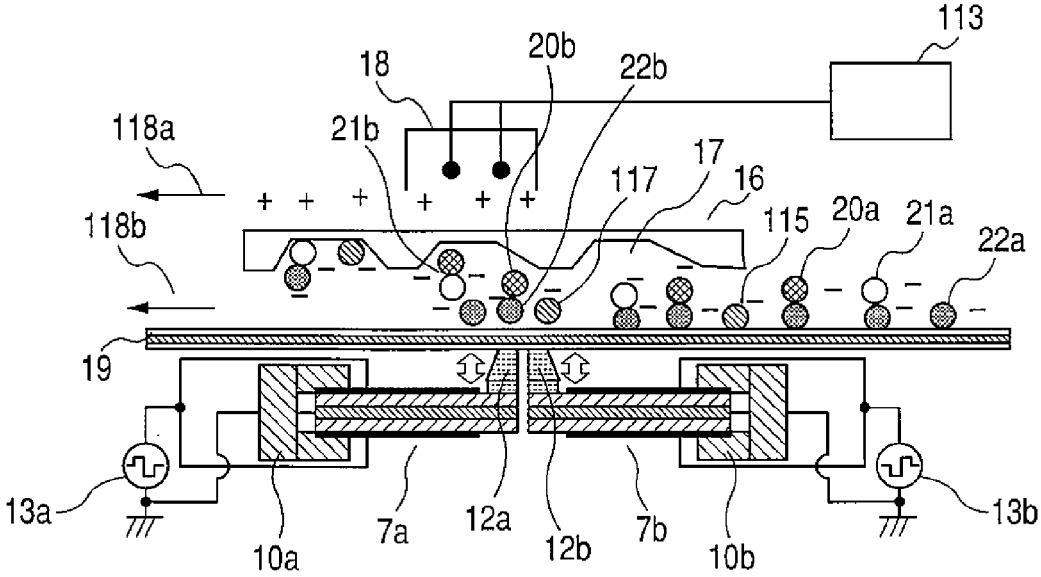
FIG. 2 is a structural diagram illustrating a transfer apparatus in the second embodiment of the present invention.

FIG. 2 is a structural diagram illustrating the transfer apparatus according to the second embodiment of the present invention. The drawing shows the structure of the apparatus that transfers a color toner image to the front surface of an embossed paper 16, the color toner image being formed on the intermediate transfer belt 19 made of polyimide resin by overlapping toners 20*a*, 21*a*, 22*a* and 115 in four colors, yellow (Y), magenta (M), cyan (C), and black (K). Many voids 17 in various shapes are formed on the surface of the embossed paper 16. Accordingly, to have each toner 20*a*, 21*a*, 22*a* and 115 comprising a plurality of layers fly from the intermediate transfer belt 19 and transfer to the surface of a void, a great inertia force must be applied to the toner 20*a*, 21*a*, 22*a* and 115. The toner 20*a*, 21*a*, 22*a* and 115 is a negatively charged toner with a particle diameter of 9 μm. The printer is a continuous paper printer with a print density of 600 dpi and a process speed (vector movement speed) of 16 ips; the printer adapts to paper with a width of 20.5 inches, the transfer width being 19.5 inches. Two bimorph actuators 6*a* and 6*b* structured as shown in FIG. 7 are disposed on the back of the belt 19, as shown in FIG. 11 (*a*). Their positions are adjusted so that during non-driving in which no voltage is applied to the actuator, the face of the protrusion 7 does not touch the back surface of the belt 19. The shim member 3 of the actuator 6 is a stainless plate with a thickness of 50 μm, a width of 560 mm, and a length of 25 mm. Six PZT plates are bonded and fixed to one surface of the shim member with an epoxy conductive adhesive, and another six PZT plates are similarly bonded to the other surface; the PZT plate has a thickness t of 300 μm, a width Wc of 80 mm, and a length Lc2 of 10 mm (of this length, an electrode is formed over a length of 5 mm). The total thickness of the resulting laminate body is 700 μm. The resonant frequencies of the actuators 7*a* and 7*b* are 3 kHz. When a rectangular wave AC voltage with a frequency of 5 kHz and a peak value of ±40 V were applied, the protrusion 7 vibrated up and down with amplitude U of about 18 μm at a frequency of 5 kHz. The difference in phase between the rectangular AC waveforms from the power supplies for 13*a* and 13*b* was 180 degrees (½ cycle). As a result, the vibration characteristics of the intermediate transfer belt 19 as shown in FIG. 11(*b*) were obtained; upward pulse-like vibration was obtained $10\times10^3$ times in a second. This value is greater than the number of lines at 600 dpi or 16 ips, which is $9.6\times10^3$, so a sufficient inertia force $F_B$ can be applied to the toner 20*a*, 21*a*, 22*a* and 115 on the intermediate transfer belt; the value of $F_B$ was 16 nN. It was then found that the toner 20*a*, 21*a*, 22*a* and 115 is released from a constraint by the van der Waals's force due to the inertia force $F_B$ and the electrostatic force $F_E$ applied by charges given to the back surface of the paper 4 by the corona transfer means, and flies in the void 17 as a toner 20*b*, 21*b*, or 22*b*, and thereby preferable transfer to the embossed paper with concaves and convexes is possible. This embodiment has been described for a case in which continuous form is used as the paper, but it should be understood that the same advantage can be obtained from cut sheets. Although the device 7*a* and 7*b* structured as shown in FIG. 7 is used, it may be structured as shown in FIGS. 4 to 6.

Third Embodiment

Figure 3:
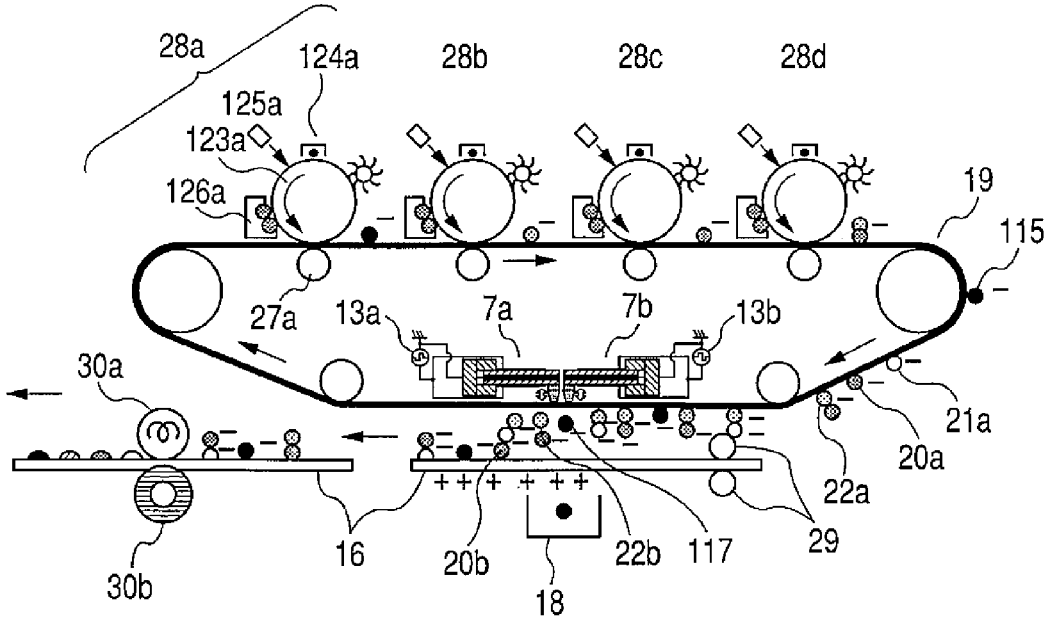
FIG. 3 is a structural diagram illustrating an image forming apparatus in the third embodiment of the present invention.

FIG. 3 is a structural diagram illustrating an image forming apparatus in which the transfer apparatus in the present invention is used. The K toner image forming part 28*a*, C toner image forming part 28*b*, M toner image forming part 28*c*, and Y toner image forming part 28*d* have basically the same structure except that they use different developers. Therefore, only the structure of the K toner image forming part 28*a* will be described below. The OPC photosensitive drum 123*a* is charged by the charger 124*a*, after which an electrostatic latent image corresponding to a print image is formed by the exposing part 125*a*. The developing unit 126*a* then forms a K toner image on the photosensitive drum. The toner 20*a*, 21*a*, 22*a* or 115 is negatively charged, so the toner image is transferred to the intermediate transfer belt 19 by the transfer roll 30*a* to which a positive voltage has been applied. A C toner image, M toner image, and Y toner image are transferred to the rotating intermediate transfer belt 19 in succession, forming a full-color image on the belt 19. A corona transfer means 18 is disposed opposite to the bimorph actuators 7*a* and 7*b* with the intermediate transfer belt 19 intervening therebetween. The print paper 16, which is a cut form, is moved by the resisting rollers 29 to the transfer part. Driving power supplies 13*a* and 13*b* are connected to the bimorph actuators 7*a* and 7*b*.

The structure of the transfer unit in this embodiment is as described in the second embodiment, so the explanation of the structure will be omitted. The toner 20, 21, 22 and 115 transferred to the paper 16 is fused and fixed to the paper by a heat roll 30*a* fixing unit comprising a heat roll 30*a* and a backup roll 30*b*. In this case, since the vibrating unit is mounted in the image forming apparatus, the vibrating unit must be disposed in the spacing surrounded by the rotating intermediate transfer belt 19. This embodiment differs from the second embodiment in that the vibrating unit is disposed vertically diametrically with respect to the belt. Accordingly, when protrusion portions 12*a* and 12*b* are displaced downwardly, the bimorph actuators 7*a* and 7*b* are brought into contact with the back surface of the belt 19 and cause it to vibrate, applying the inertia force $F_B$ to the toner. The protrusion portion 12 is preferably made of a material superior in wear resistance and low in specific gravity, such as aluminum or polycarbonate.

The driving of the vibrating unit comprising the bimorph actuators 7*a* and 7*b* can be selected according to the type of paper 16. When coated paper or woodfree paper, the surface which is relatively flat, is used, only corona transfer may be performed. The vibrating unit may be operated only for embossed paper and other types of paper 16 having concaves and convexes on the surface. It should be understood that when the vibrating unit is operated regardless of the type of paper, transfer performance is increased to the extent by which an inertia force is applied to the toner.

The bimorph vibrating source device may use any of the structures shown in FIGS. 4 to 7 (this has not been described above).

Fourth Embodiment

Figure 16A:
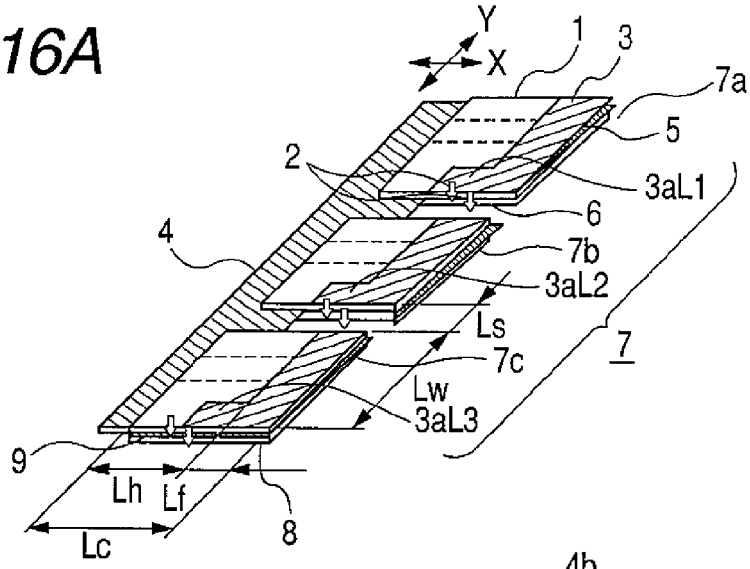
FIGS. 16A to 16C are structural diagrams illustrating a wide piezoelectric bimorph element according to the fourth embodiment and a vibrating means using it.
Figure 16B:
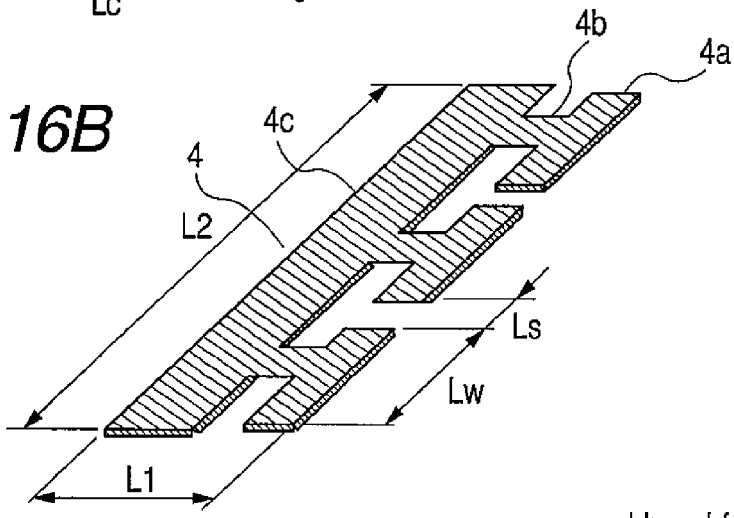
Figure 16C:
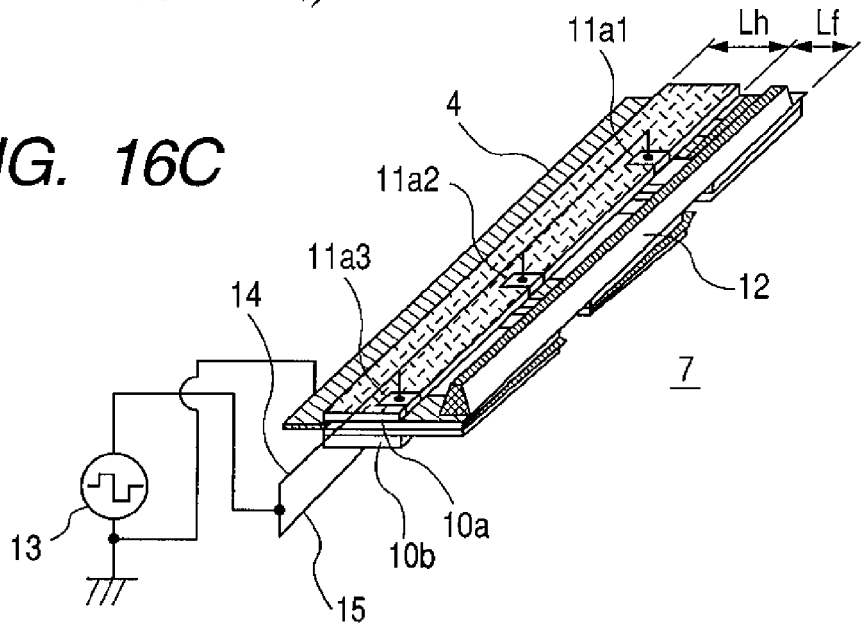

FIGS. 16(*a*) to 16(*c*) illustrate another structure of a wide piezoelectric bimorph element 7, which is the main device of the vibrating means used in the present invention to improve the efficiency of transfer. FIG. 16(*b*) shows the shape of the shim member 4, which is obtained by linking three T-shaped areas (each of which comprises 4*a* and 4*b*), shown in FIG. 19(*b*), in a rectangular area 4*c*. The shim member 4 is formed by machining a phosphor bronze plate with a thickness of 50 μm, a width $L_1$ of 30 mm, and a length $L_2$ of 422 mm; $L_w$ is 140 mm and $L_s$ is 1 mm. FIG. 16(*a*) shows the shape of the wide piezoelectric bimorph element 7.

Three PZT plates 1 are bonded to one surface of the shim member 4 with an adhesive, and another three PZT plates 5 are similarly bonded to the other surface. These plates have the same size; 300 μm in thickness, 140 μm in width ($L_w$), and 30 mm in length ($L_c$). Their polarization 2 is oriented in the same direction (in FIG. 16(*a*), downward). As in FIGS. 19(*a*) to 19(*d*), a conductive adhesive, in which sliver particles are mixed, is used in the areas 8 in which the piezoelectric bodies 1 and 5 are bonded to the area 4*a* on the shim member 4, and an isolative adhesive is used for the rest areas 9. The two adhesives were selected so that a difference in their characteristics is lessened; after curing, the hardness of these adhesives is 60 to 80 (Shore D) and the their glass transition temperature is 70° C. to 80° C. Otherwise, when the lamination of the shim member 4 and the piezoelectric bodies 1 and 5 vibrates as the piezoelectric bimorph element 7, distortion would occur on the boundary between the areas 8 in which the adhesive is cured, resulting in interfacial peeling.

A piezoelectric distortion constant $d_{31}$ of the PZT used is $330\times10^{-12}$(C/N), a Young's modulus of it is $5.9\times10^{10}$(N/m$^2$) and a density of it is $7.75\times10^3$(kg/m$^3$), differing from the PZT property used in the FIG. 8. As the constant $d_{31}$ is three times larger than the PZT property used in the FIG. 8, a driving voltage can be reduce to ±40V. And a vibration displacement quantity is larger, too. The adhesive was cured at 60° C., which is lower than the Curie point (160° C.) of the PZT used, for six hours. Since the piezoelectric bodies 1 and 5 deform not only in the Y direction but also in the X direction when a voltage is applied to the piezoelectric bimorph element 7, a space $L_k$ is left between adjacent piezoelectric bodies to prevent them from being brought into contact with each other.

FIG. 16(*c*) illustrates a structure of the vibrating apparatus in which the wide piezoelectric bimorph element 7 in FIG. 16(*a*) is used. The piezoelectric bimorph element 7 is held by the fixing members 10*a* and 10*b* from above and below in the areas, of the piezoelectric bimorph element 7, with a width of Lh. A power feeding line 14 is connected through notches 11*a*1, 11*a*2, and 11*a*3 formed in the fixing member 10*a* to the electrodes 3*a*L1, 3*a*L2, and 3*a*L3 on the upper piezoelectric bodies. Similarly, a power feeding line 15 is connected through notches 11*b*1, 11*b*2, and 11*b*3 (not shown) formed in the fixing member 10*b* to the electrodes 6*b*L1, 6*b*L2, and 6*b*L3 (not shown).

The power feeding lines 14 and 15 are connected together to the high-voltage side of the AC driving power supply 13, and the power feeding line to the shim member 4 is connected to the ground side of the AC driving power supply 13. When a voltage is supplied from the AC driving power supply 13 to the piezoelectric bimorph element 7, the protrusion portion 12 disposed on the surface of the free end area 34 (with a length of $L_f$) vibrates up and down.

Figure 17:
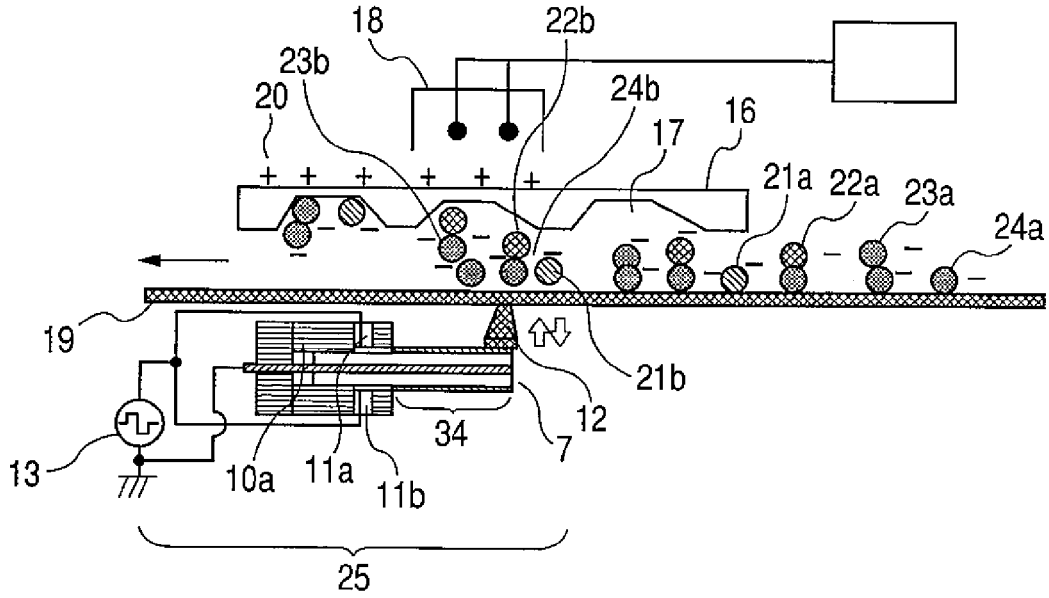
FIG. 17 is a structural diagram illustrating the transfer unit of the fourth embodiment that uses the vibrating means of the present invention.

FIG. 17 is a structural diagram illustrating the transfer apparatus in the invention. A color toner image is formed on the intermediate transfer belt 19 made of polyimide resin by overlapping negatively charged toners 22, 23, 24, and 21 of four colors, yellow (Y), magenta (M), cyan (C), and black (K). The color image is transferred to the front surface of an embossed paper 16. The vibrating means in FIGS. 16(*a*) to 16(*c*) is disposed on the backside of the intermediate transfer belt 19. Positive charges 20 are applied to the backside of the paper by the corona transfer unit 18.

Vibration energy is applied to the backside of the intermediate transfer belt 19 so that an inertia force acts on the toners 22, 23, 24, and 21. The toners 22, 23, 24, and 21 thereby fly and are transferred from the intermediate transfer belt 19 to the concave 17 in the front surface of the paper 16. The diameter of a particle of the toners 22, 23, 24, and 21 is 9 μm. If $L_f$ is 10 mm, then the resonant frequency is 1.6 kHz. When a rectangular wave AC voltage with a frequency of 1.6 kHz and a peak value of ±40 V was applied to the piezoelectric bimorph element 7 as the driving voltage, the protrusion portion 12 vibrated up and down with amplitude of about ±200 μm. An inertia force $F_B$ of about 12 nN then acts on the toners 22, 23, 24, and 21 on the intermediate transfer belt 19.

As a result, the toners 21*b*, 22*b*, 23*b*, and 24*b* receive not only the electrostatic force $F_E$ due to the positive charge 20 applied on the back of the paper 16 by the corona transfer means 18 but also the above inertia force $F_B$, so these toners are released from the constraint by the van der Waals's force and fly to the concave 17 and a flat part on the paper 16, indicating that superior transfer to the embossed paper is possible. Although an embossed cut sheet was used as the paper 16 in this embodiment, it should be understood that the embodiment could be applied to all types of paper including paper having concaves and convexes on the front surface, flat paper, and continuous paper.

Although the width $L_2$ of the wide piezoelectric bimorph element 7 in this embodiment is 422 mm, it is also possible to use another wide piezoelectric bimorph element 7 with a width of 20 inches (508 mm) or more by widening the width of the shim member 4 and using more piezoelectric bodies 1 and 5. PVDF films, which are piezoelectric films, can also be used as the piezoelectric bodies 1 and 5.

Fifth Embodiment

Figure 18:
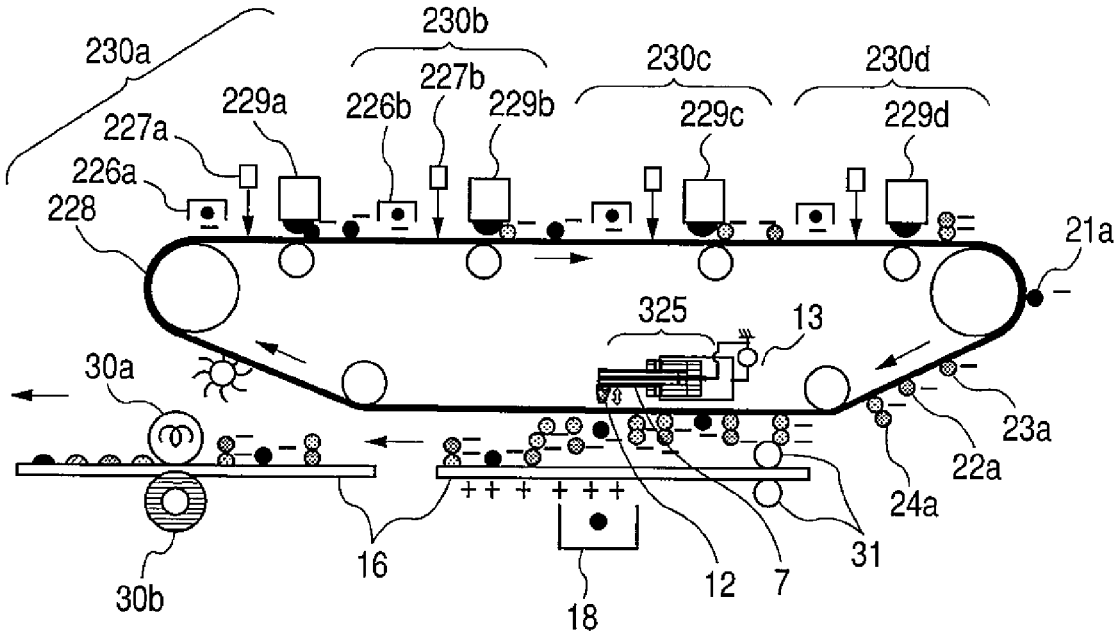
FIG. 18 is a structural diagram illustrating an image forming apparatus of the fifth embodiment that uses the transfer apparatus in the first embodiment is used.
Figures 1, 19A:
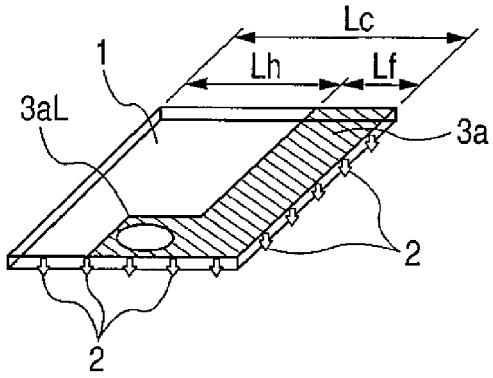
Figures 2, 19A:
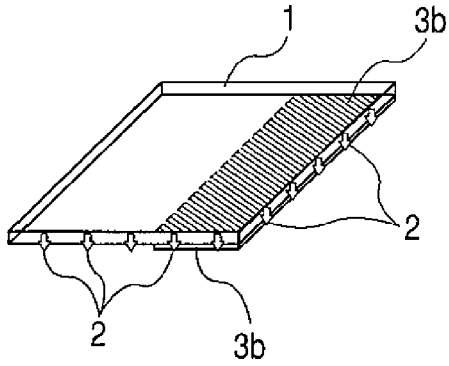
Figure 19B:
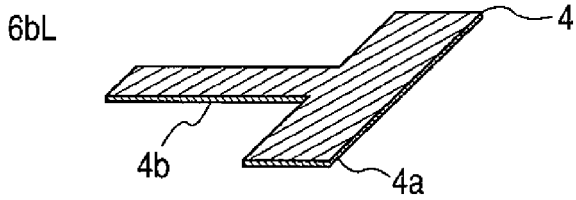
Figures 1, 19C:
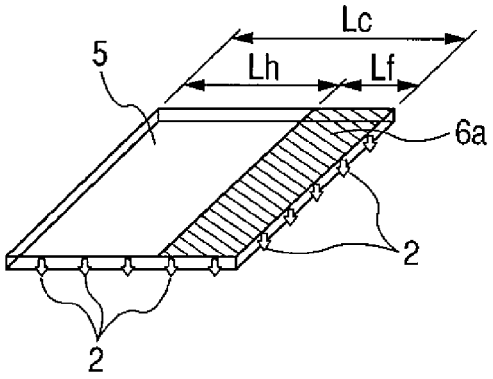
Figures 2, 19C:
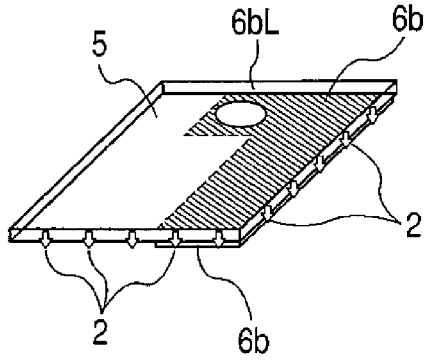
Figure 19D:
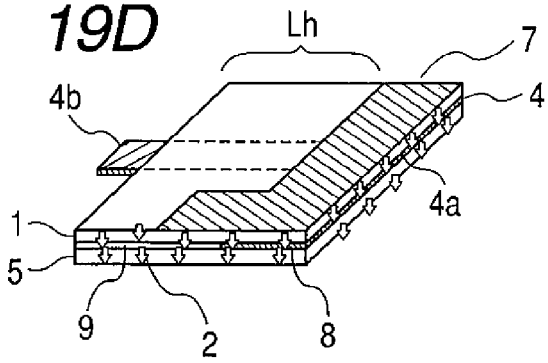

FIG. 18 illustrates the structure of another image forming apparatus that uses the transfer apparatus in the invention. A K toner image forming part 230*a*, C toner image forming part 230*b*, M toner image forming part 230*c*, and Y toner image forming part 230*d* are disposed so that they face the rotating OPC photosensitive belt 228. This apparatus use different developers, but have basically the same structure. The structures and processes of the K toner image forming part 230*a* and C toner image forming part 230*b* will be described below.

The OPC photosensitive belt 228 is charged by the charger 226*a*, after which an optical pattern corresponding to a K toner image is exposed by the exposing part 227*a* including a laser optics and LED so as to form an electrostatic latent image. The developing unit 229*a* then forms a K toner image on the OPC photosensitive belt 228. The surface of the OPC photosensitive belt 228 is then charged by the charger 226*b* so as to restore the potential of an area in which potential reduction was caused by light illumination by the exposing part 227*a*. Next, an optical pattern corresponding to a C toner image is exposed by the exposing part 227*b* so as to form an electrostatic latent image, and the developing unit 229*b* forms a C toner image on the OPC photosensitive belt 228.

The developing rolls of the developing units 229*b*, 229*c*, and 229*d* are disposed so that their surfaces do not touch the photosensitive belt 228, preventing the toner image formed on the photosensitive belt 228 from being scratched by the developing rolls. When an M toner image and Y toner image are then formed in succession in this way, a color image comprising the K toner 21*a*, C toner 22*a*, M toner 23*a*, and Y toner 24*a* is formed on the photosensitive belt 228.

A corona transfer unit 18 is disposed outside the rotating OPC photosensitive belt 228, and a vibrating means 25, which uses the piezoelectric bimorph element 7, is disposed inside. A driving power supply 13 is connected to the vibrating means 325. The driving power supply 13 is a rectangular wave or sine wave AC power supply. When the protrusion portion 12 of the piezoelectric bimorph element 7 is displaced downward, it touches the backside of the photosensitive belt 228 and applies an inertia force $F_B$ to the toners 21*a*, 22*a*, 23*a*, and 24*a*.

The paper 16, which is a cut form, is moved by the resisting rollers 31 to the transfer part. The toners 21*a*, 22*a*, 23*a*, and 24*a* transferred to the paper 16 are fused and fixed to the paper 16 by a heat roll fixing unit comprising a heat roll 30*a* and a backup roll 30*b*. This completes printing.

The driving of the vibrating means 325 can be selected according to the type of paper 16. When coated paper or woodfree paper, the surface on which is relatively flat, is used, only corona transfer is performed; the vibrating unit 325 is operated only for paper 16 having concaves and convexes, such as embossed paper. It should be understood that when the vibrating unit 325 is operated, transfer performance is increased to the extent by which an inertia force is applied to the toner 21*a*, 22*a*, 23*a* and 24*a*, regardless of the type of paper. In the description so far, a cut form has been used. If the system for moving the paper 16 is modified so as to adapt to continuous form, the image forming apparatus can handle continuous paper.

The OPC photosensitive belt 228 in the third embodiment servers as a toner image supporting body as in the case of the intermediate transfer belt 19 in the fifth embodiment. Accordingly, when a toner image is transferred from this type of flexible toner image supporting body to a recording medium, the transfer apparatus in the invention can be used. In the fifth and sixth embodiments, color printing using toners 21*a*, 22*a*, 23*a*, and 24*a* in four colors has been described; the transfer apparatus can of course also be applied to monochrome images.

Electrophotographic printers can print variable information on a recording medium such as paper at high speed, so they have been used in a wide range of fields from business printing to personal printing. As these printers are spread, printing on many types of paper and wide paper, which conventional electrophotographic printers could not handle, is being demanded. Specifically, printing on inexpensive, roughened surface paper, double-sided printing for use paper resources effectively, and color printing on embossed paper to produce tickets and brochures are demanded. Demands for wide paper ranges from A3 cut sheets (420 mm or 16.54 inches) to continuous paper 20.5 inches wide. An object of the present invention to meet these demands for the transfer mechanism is to develop a compact transfer apparatus with a low power consumption that can uniformly transfer a toner image over a wide area even when the paper has large concaves and convexes on the surface and there is no sufficient contact between the paper and the toner image supporting body such as a photo sensitive body or intermediate transfer body.

The transfer apparatus in the invention uses the mechanical vibration of a bimorph element that employs the transverse vibration ($d_{31}$ mode) of a piezoelectric body and it is possible to transfer the toner image uniformly in a broad area. Further, the vibrating unit of the transfer apparatus can be made to be compact and consume less power when compared with a method in which a horn and an ultrasonic oscillator that uses the longitudinal vibration ($d_{33}$ mode) of a conventional piezoelectric body are combined. Accordingly, when the transfer apparatus in the invention is applied to an image forming apparatus, the image forming apparatus can print an image of high quality on a variety of paper and a wide paper to which a conventional electrophotographic method cannot be applied and it can deal with printing on roughened surface paper, double-sided printing, and printing on embossed paper.

What is claimed is:

1. A transfer apparatus comprising a toner image supporting body; a corona transfer means, which is oppositely disposed to a toner image supporting body, wherein an electrostatic toner image formed on the toner image supporting body is transferred to a recording medium transported to a transfer area disposed between the toner image supporting body and the corona transfer means; and a vibrating unit that applies vibration energy to a back side of the toner image supporting body, the vibrating unit being disposed opposite to the corona transfer means with the toner image supporting body intervening therebetween, wherein the vibrating unit has a cantilever structure for holding one end of a piezoelectric bimorph-type actuator having such a structure that a pair of piezoelectric bodies each having an electrodes on the surface thereof are bonded, and a protrusion portion is provided at an end of the cantilever opposite to a supporting and fixing part of the piezoelectric bimorph-type actuator, and reciprocal vibration, which is caused when a voltage is applied to the pair of piezoelectric bodies, is transmitted to the back side of the toner image supporting body through the protrusion portion;

wherein an area of the piezoelectric body in said supporting and fixing part is an inactive area where said electrodes does not exist;

wherein a non-polarized area is reserved in advance in said inactive area during polarization of the piezoelectric body, or even when an entire surface of the piezoelectric body has been polarized, there is no driving electrode on the surface of the piezoelectric body.

2. The transfer apparatus according to claim 1, wherein an area of the piezoelectric body that corresponds to the protrusion portion disposed at the end opposite to said supporting and fixing part is an inactive area where said electrodes does not exist.

3. The transfer apparatus according to claim 1, wherein a power supply for applying a voltage to the piezoelectric body generates an AC voltage, the AC voltage being a sine AC or a rectangular AC.

4. The transfer apparatus according to claim 3, wherein a frequency of the AC voltage or the pulse voltage of the power supply is a resonant frequency of the cantilever structure.

5. The transfer apparatus according to claim 1, wherein a power supply for applying a voltage to the piezoelectric body generates a one-polarity pulse voltage.

6. An image forming apparatus comprising the transfer apparatus according to claim 1, and a fixing device for fixing the toner image transferred to the recording medium.

7. A transfer apparatus comprising a toner image supporting body; a corona transfer means, which is oppositely disposed to a toner image supporting body, wherein an electrostatic toner image formed on the toner image supporting body is transferred to a recording medium transported to a transfer area disposed between the toner image supporting body and the corona transfer means; and a vibrating unit that applies vibration energy to a back side of the toner image supporting body, the vibrating unit being disposed opposite to the corona transfer means with the toner image supporting body intervening therebetween, wherein the vibrating unit has a cantilever structure for holding one end of a piezoelectric bimorph-type actuator having such a structure that a pair of piezoelectric bodies each having an electrodes on the surface thereof are bonded, and a protrusion portion is provided at an end of the cantilever opposite to a supporting and fixing part of the piezoelectric bimorph-type actuator, and reciprocal vibration, which is caused when a voltage is applied to the pair of piezoelectric bodies, is transmitted to the back side of the toner image supporting body through the protrusion portion;

wherein the piezoelectric bodies are piezoelectric ceramic plates or piezoelectric films, and are formed by bonding a plurality of the piezoelectric bodies to a single shim member, which is an elastic reinforcing plate;

wherein said piezoelectric bimorph-type actuator has a parallel structure in which the piezoelectric bodies are bonded to both sides of the shim member so that polarization directions of the piezoelectric bodies in thickness directions thereof are the same, dimensions of the piezoelectric body on the side on which the protrusion portion is disposed is shorter than dimensions of the shim member, and the protrusion portion is disposed on an area of the shim member on which the piezoelectric body does not exist.

8. The transfer apparatus according to claim 7, comprising a wide piezoelectric bimorph-type actuator, the width of the shim plate being equal to or more than the width of the transfer area from which a transfer occurs to said recording medium, a plurality of the piezoelectric bodies are bonded on both sides of the shim member in the direction of the width of the transfer area, the electrodes are formed on the external surfaces of the plurality of the piezoelectric bodies, and expansion and contraction of each of the plurality of the piezoelectric bodies, which occur when a voltage is applied, are transmitted to the transfer area by using the shim member as a common base.

9. The transfer apparatus according to claim 7, wherein the protrusion portion, which is disposed at the end opposite to the supporting and fixing part of said piezoelectric bimorph-type actuator, has an integrated structure made of metal or resin, and bonded and fixed to a surface of the piezoelectric bodies or the shim member.

10. A transfer apparatus comprising a toner image supporting body; a corona transfer means, which is oppositely disposed to a toner image supporting body, wherein an electrostatic toner image formed on the toner image supporting body is transferred to a recording medium transported to a transfer area disposed between the toner image supporting body and the corona transfer means; and a vibrating unit that applies vibration energy to a back side of the toner image supporting body, the vibrating unit being disposed opposite to the corona transfer means with the toner image supporting body intervening therebetween, wherein the vibrating unit has a cantilever structure for holding one end of a piezoelectric bimorph-type actuator having such a structure that a pair of piezoelectric bodies each having an electrodes on the surface thereof are bonded, and a protrusion portion is provided at an end of the cantilever opposite to a supporting and fixing part of the piezoelectric bimorph-type actuator, and reciprocal vibration, which is caused when a voltage is applied to the pair of piezoelectric bodies, is transmitted to the back side of the toner image supporting body through the protrusion portion;

wherein the piezoelectric bodies are piezoelectric ceramic plates or piezoelectric films, and are formed by bonding a plurality of the piezoelectric bodies to a single shim member, which is an elastic reinforcing plate;

wherein said piezoelectric bimorph-type actuator has a parallel structure in which the piezoelectric bodies are bonded to both sides of the shim member so that polarization directions of the piezoelectric bodies in thickness directions thereof are the same, dimensions of an area on the shim member on the side of the support and fixing part of the cantilever structure is longer than dimensions of the piezoelectric body, and the shim member is supported and fixed on the area of the shim member on which the piezoelectric body does not exist.

11. A transfer apparatus comprising a toner image supporting body; a corona transfer means, which is oppositely disposed to a toner image supporting body, wherein an electrostatic toner image formed on the toner image supporting body is transferred to a recording medium transported to a transfer area disposed between the toner image supporting body and the corona transfer means; and a vibrating unit that applies vibration energy to a back side of the toner image supporting body, the vibrating unit being disposed opposite to the corona transfer means with the toner image supporting body intervening therebetween, wherein the vibrating unit has a cantilever structure for holding one end of a piezoelectric bimorph-type actuator having such a structure that a pair of piezoelectric bodies each having an electrodes on the surface thereof are bonded, and a protrusion portion is provided at an end of the cantilever opposite to a supporting and fixing part of the piezoelectric bimorph-type actuator, and reciprocal vibration, which is caused when a voltage is applied to the pair of piezoelectric bodies, is transmitted to the back side of the toner image supporting body through the protrusion portion;

wherein two cantilever structures, each of which has the protrusion portion for applying vibration to the toner image supporting body, are disposed so that the protrusion portions of the two cantilever structures are brought close to each other and face the corona transfer means with the toner image supporting body intervening therebetween.

12. The transfer apparatus according to claim 11, wherein power supplies for applying a voltage to the piezoelectric bodies of the two cantilever structures generate an AC voltage or pulse voltage; and there is a phase shift equal to a half cycle between a phase of a voltage wave applied to the piezoelectric bodies of one cantilever structure and a phase of a voltage wave applied to the piezoelectric bodies of the other cantilever structure.

13. A transfer apparatus comprising a toner image supporting body; a corona transfer means, which are oppositely disposed; and a vibrating unit disposed opposite to the corona transfer means with the toner image supporting body intervening therebetween, the vibrating unit applying vibration energy to a backside of the toner image supporting body, the transfer apparatus electrostatically transferring a toner image formed on the toner image supporting body to a recording medium transported to a transfer area disposed between the toner image supporting body and the corona transfer means, wherein the vibrating unit has a cantilever structure for holding an end of a piezoelectric bimorph element in which a pair of piezoelectric bodies each having an electrode formed on each of the piezoelectric bodies, are bonded to both sides of a shim member, and a protrusion portion is provided on the other end of the piezoelectric bimorph element; and no voltage is applied to a part of each of the piezoelectric bodies, holding the piezoelectric bimorph element when a driving voltage is applied between the electrode on the surface of the pair of the piezoelectric bodies and the shim member;

wherein the piezoelectric bimorph element is formed of the piezoelectric bodies bonded to both sides of the shim member through an adhesive layer; and a bonding part between the piezoelectric body and the shim member includes a part in which a conductive adhesive is used and another part in which an isolative adhesive is used.

14. The transfer apparatus according to claim 13, wherein there is a part in which the electrode formed on the surface of the piezoelectric body and the shim member overlap, and a part of the piezoelectric body, in which distortion occurs substantially due to a reverse piezoelectric effect does not include a part holding the piezoelectric bimorph element.

15. The transfer apparatus according to claim 13, wherein there is a part in which the electrode formed on the surface of the piezoelectric body and the shim member overlap, and a part of the piezoelectric body, in which distortion occurs substantially due to a reverse piezoelectric effect includes only a vibration area including a free end of the piezoelectric bimorph element.

16. The transfer apparatus according to claim 13, wherein after hardening the conductive adhesive and the isolative adhesive, hardness and glass transition temperature of the conductive adhesive and the isolative adhesive are approximately the same.

17. The transfer apparatus according to claim 13, wherein a lead from the electrode on the surface of the piezoelectric body is provide in a support member area of the piezoelectric bimorph element.

18. The transfer apparatus according to claim 13, wherein the transfer apparatus is a wide piezoelectric bimorph element in which the piezoelectric body comprises a piezoelectric ceramic plate or a piezoelectric film, the width of the shim member is equal to or more than the width of the transfer area, a plurality of the piezoelectric bodies are bonded on both sides of the shim member to be arranged in the direction of the width of the transfer area at fixed intervals, and expansion and contraction of each of the piezoelectric bodies, which occur when a voltage is applied, are received by using the shim member as a common base.

19. An image forming apparatus comprising, a toner image supporting body, which includes an intermediate transfer belt or a photosensitive belt on which a toner image is formed; and the transfer apparatus according to claim 18, which is disposed opposite to the rotating toner image supporting body and transfers the toner image to a recording medium.

20. An image forming apparatus comprising, a photosensitive drum; a charger;

an exposing portion for exposing an optical pattern corresponding to a print image and forming a toner image on the photosensitive drum;

an intermediate transfer belt, which rotates, to which the toner image is transferred by a transfer role; and the transfer apparatus according to claim 18, which is disposed corresponding to the rotating intermediate transfer belt and electrostatically transfers the toner image to a recording medium.

21. An image forming apparatus comprising, a charger;

an exposing portion for exposing an optical pattern corresponding to a print image and forming a toner image on the photosensitive belt; and the transfer apparatus according to claim 18, which is disposed corresponding to the rotating photosensitive belt and electrostatically transfers the toner image to a recording medium.

22. A transfer apparatus comprising a toner image supporting body; a corona transfer means, which are oppositely disposed; and a vibrating unit disposed opposite to the corona transfer means with the toner image supporting body intervening therebetween, the vibrating unit applying vibration energy to a backside of the toner image supporting body, the transfer apparatus electrostatically transferring a toner image formed on the toner image supporting body to a recording medium transported to a transfer area disposed between the toner image supporting body and the corona transfer means, wherein the vibrating unit has a cantilever structure for holding an end of a piezoelectric bimorph element in which a pair of piezoelectric bodies each having an electrode formed on each of the piezoelectric bodies, are bonded to both sides of a shim member, and a protrusion portion is provided on the other end of the piezoelectric bimorph element; and no voltage is applied to a part of each of the piezoelectric bodies, holding the piezoelectric bimorph element when a driving voltage is applied between the electrode on the surface of the pair of the piezoelectric bodies and the shim member;

wherein the piezoelectric body is formed of a piezoelectric ceramic plate or a piezoelectric film;

an entire surface of the piezoelectric body undergoes polarization in a thickness direction thereof; and the electrode is formed on a particular area on the surface of the piezoelectric ceramic plate or the piezoelectric film;

wherein additional electrodes are disposed on both sides of the piezoelectric ceramic plate, an area of which the electrodes are disposed is done polarization by applying a high DC voltage to the electrodes, parts of which are removed, and the other parts of which are left in necessary areas for applying an driving voltage for driving as the piezoelectric bimorph element.

23. A method of manufacturing a transfer apparatus that has a toner image supporting body and a corona transfer means, which are oppositely disposed, and includes a vibrating unit disposed opposite to the corona transfer means with the toner image supporting body intervening therebetween, the vibrating unit applying vibration energy to a backside of the toner image supporting body, the vibrating unit having a cantilever structure in which the vibrating unit holds an end of a piezoelectric bimorph element in which a pair of piezoelectric bodies, on each of which an electrode is formed, are bonded to both sides of a shim member, and a protrusion portion is provided on the other end of the piezoelectric bimorph element, the transfer apparatus electrostatically transferring a toner image formed on the toner image supporting body to a recording medium transported to a transfer area disposed between the toner image supporting body and the corona transfer means comprising the steps of:

forming the piezoelectric body of a piezoelectric ceramic plate; and performing a polarization on an entire surface of the piezoelectric body in a thickness direction thereof, wherein the step of performing polarization comprises the step of forming electrodes for performing polarization on both sides of the piezoelectric ceramic plate, the step of performing polarization by applying a high DC voltage to the electrodes for performing polarization, and the step of removing a part of the electrode for performing polarization to form electrodes on a surface of the piezoelectric ceramic plate.

* * * * *